US011460234B2

(12) United States Patent
Baik et al.

(10) Patent No.: US 11,460,234 B2
(45) Date of Patent: Oct. 4, 2022

(54) REFRIGERATOR

(71) Applicant: LG Electronics, Inc., Seoul (KR)

(72) Inventors: Wookyung Baik, Seoul (KR); Kyungseok Kim, Seoul (KR); Jeongwon Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 209 days.

(21) Appl. No.: 16/648,966

(22) PCT Filed: Sep. 19, 2018

(86) PCT No.: PCT/KR2018/011075

§ 371 (c)(1),
(2) Date: Mar. 19, 2020

(87) PCT Pub. No.: WO2019/059650

PCT Pub. Date: Mar. 28, 2019

(65) Prior Publication Data

US 2020/0284495 A1 Sep. 10, 2020

(30) Foreign Application Priority Data

Sep. 22, 2017 (KR) ..... 10-2017-0122584

(51) Int. Cl.
*F25D 11/02* (2006.01)
*F25D 17/06* (2006.01)
(Continued)

(52) U.S. Cl.
CPC ..... *F25D 19/02* (2013.01); *F25D 11/02* (2013.01); *F25D 17/06* (2013.01); *F25D 23/06* (2013.01);
(Continued)

(58) Field of Classification Search
CPC .. F25D 23/006; F25D 23/062; F25D 23/0032; F25D 23/003
See application file for complete search history.

(56) References Cited

U.S. PATENT DOCUMENTS 3,116,615 A 1/1964 Harle
3,216,217 A * 11/1965 Kesling ..... F25D 17/065 62/289
(Continued)

FOREIGN PATENT DOCUMENTS

CN 1197917 A 11/1998
CN 2550700 Y 5/2003
(Continued)

OTHER PUBLICATIONS

Notice of Allowance of Korean Patent Office in Appl'n No. 10-2017-0122584, dated Jul. 7, 2022.

*Primary Examiner* — Ana M Vazquez
(74) *Attorney, Agent, or Firm* — Dentons US LLP

(57) ABSTRACT

A refrigerator includes a body including at least one storage compartment and a cooling module accommodating space, a door to open and close the storage compartment, and a cooling module accommodated in the cooling module accommodating space. The cooling module may include a heat radiating part, a heat absorption part, and a cooling module barrier to separate the heat radiating part and the heat absorption part. The heat radiating part may be disposed eccentrically on one of lateral sides of the cooling module and the heat absorption part may be disposed at a lateral side of the heat radiating part.

26 Claims, 13 Drawing Sheets

(51) Int. Cl.
*F25D 23/06* (2006.01)
*F25D 19/02* (2006.01)

(52) U.S. Cl.
CPC .. *F25D 2317/066* (2013.01); *F25D 2321/143* (2013.01)

(56) References Cited

U.S. PATENT DOCUMENTS

| | | | | |
|---|---|---|---|---|
| 5,809,789 | A | 9/1998 | Baker et al. | |
| 6,044,654 | A | 4/2000 | Igari et al. | |
| 7,905,614 | B2 | 3/2011 | Aoki | |
| 8,959,946 | B2 * | 2/2015 | Gorz | F25D 17/065 62/414 |
| 9,109,819 | B2 | 8/2015 | Shin et al. | |
| 2006/0207276 | A1 | 9/2006 | Daddis, Jr. et al. | |
| 2010/0139309 | A1 * | 6/2010 | Kim | F25D 17/065 62/419 |
| 2012/0291475 | A1 * | 11/2012 | Cur | F25D 11/02 62/441 |
| 2013/0086936 | A1 | 4/2013 | Choi et al. | |
| 2015/0272345 | A1 | 10/2015 | Bhatia et al. | |

FOREIGN PATENT DOCUMENTS

| | | | |
|---|---|---|---|
| CN | 101238338 | A | 8/2008 |
| DE | 1161921 | B | 1/1964 |
| DE | 1241847 | B | 6/1967 |
| EP | 1371922 | A2 | 12/2003 |
| EP | 2664873 | A2 | 11/2013 |
| ES | 2115433 | A1 | 6/1998 |
| JP | 2000314580 | A | 11/2000 |
| JP | 2007249537 | A | 9/2007 |
| JP | 2012042158 | A | 3/2012 |
| KR | 19980014956 | U | 6/1998 |
| KR | 19990057131 | A | 7/1999 |
| KR | 10-2003-0027367 | A | 4/2003 |
| KR | 10-2007-0022047 | A | 2/2007 |
| KR | 10-0919822 | A | 9/2009 |
| KR | 10-0933635 | A | 12/2009 |
| KR | 1020110107653 | A | 10/2011 |
| KR | 10-1245263 | A | 3/2013 |
| KR | 1020140113076 | A | 9/2014 |
| KR | 1020160005987 | A | 1/2016 |
| KR | 10-2017-0094537 | A | 8/2017 |
| RU | 2009148373 | A | 7/2011 |
| RU | 2426963 | C1 | 8/2011 |
| RU | 2447376 | C1 | 4/2012 |
| RU | 2496063 | C2 | 10/2013 |
| RU | 2632982 | C2 | 10/2017 |
| SU | 234431 | A1 | 1/1969 |
| WO | 2006101513 | A1 | 9/2006 |
| WO | 2009141125 | A1 | 11/2009 |
| WO | 2010043009 | A2 | 4/2010 |

* cited by examiner

【Figure 1】
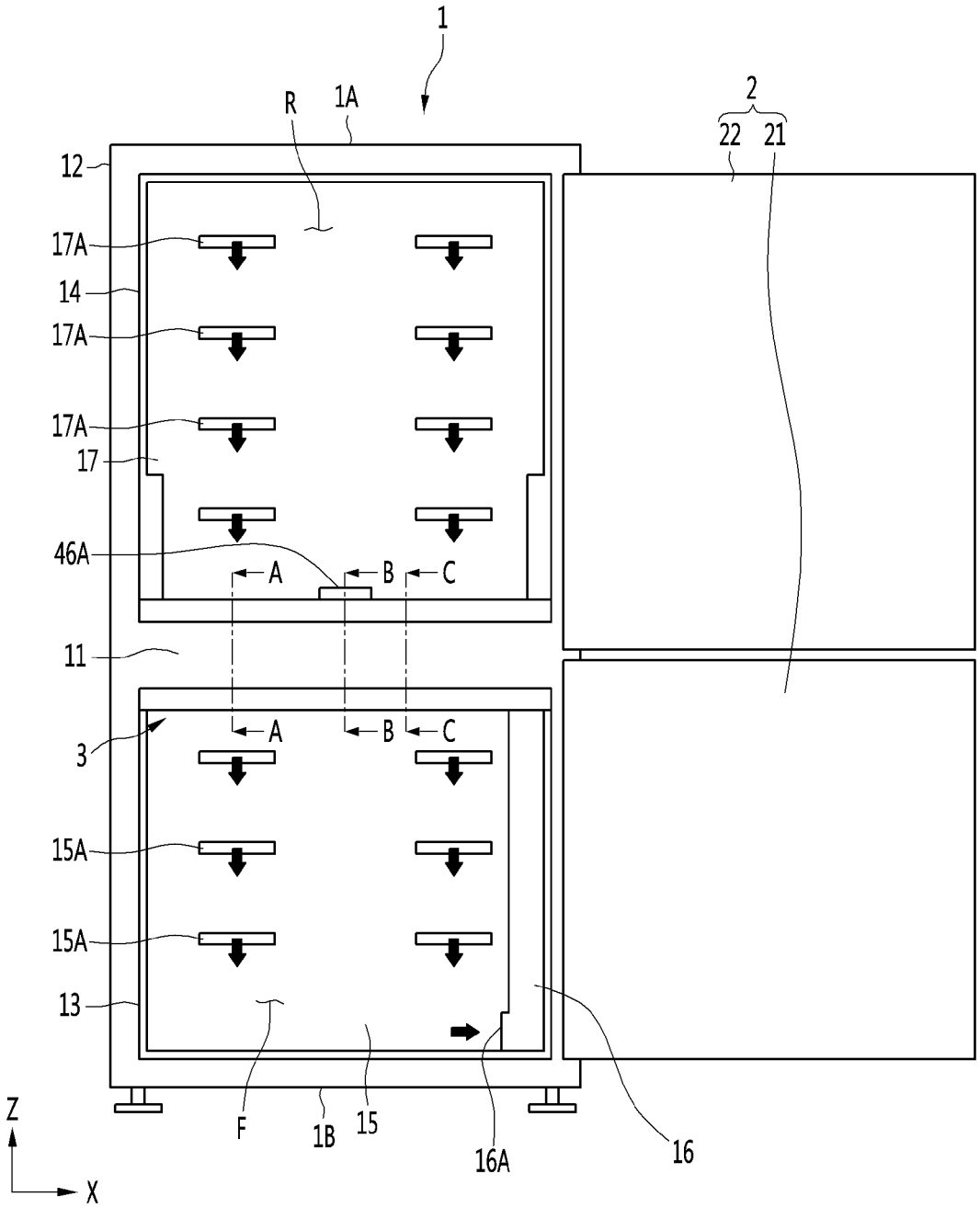

【Figure 2】
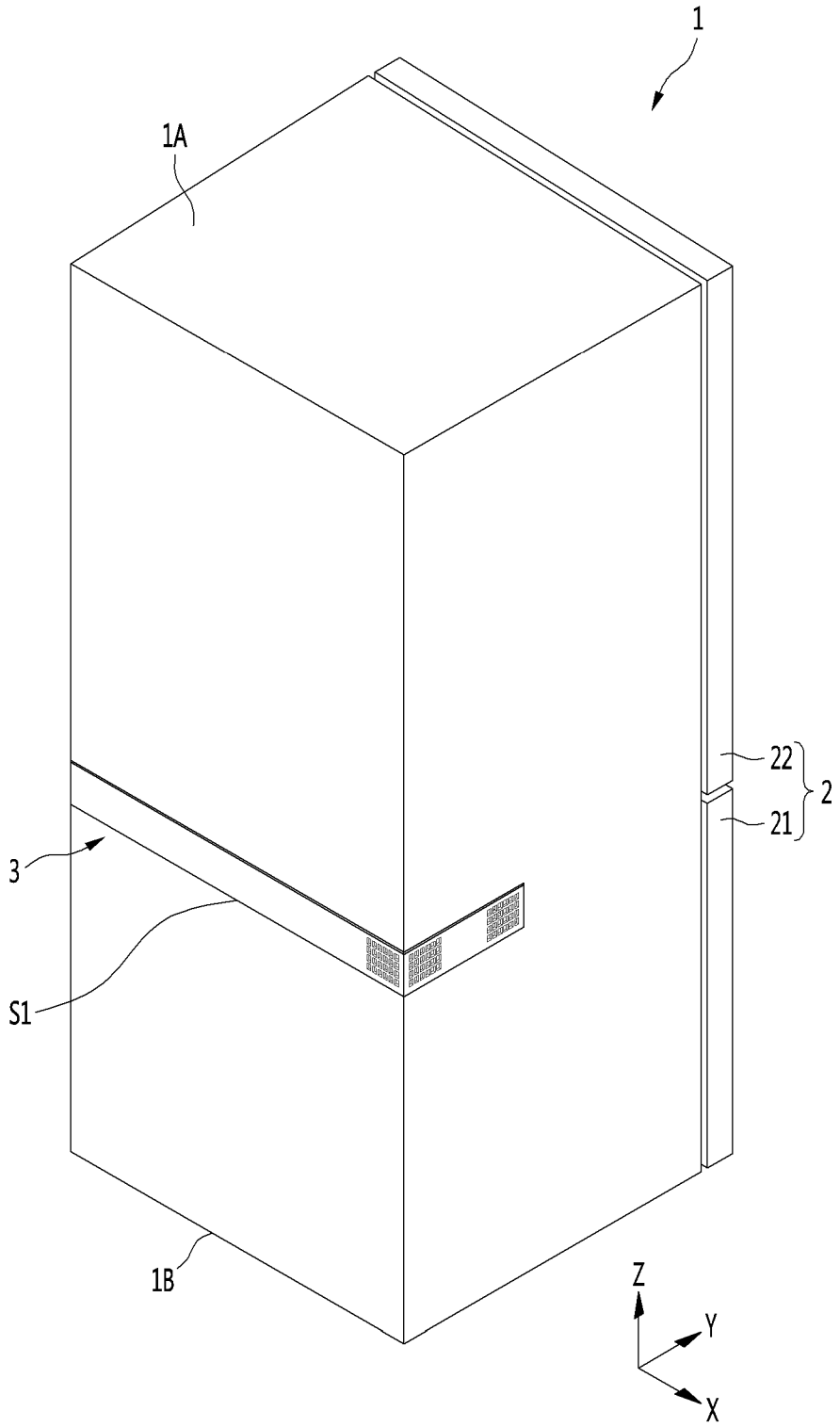

【Figure 3】
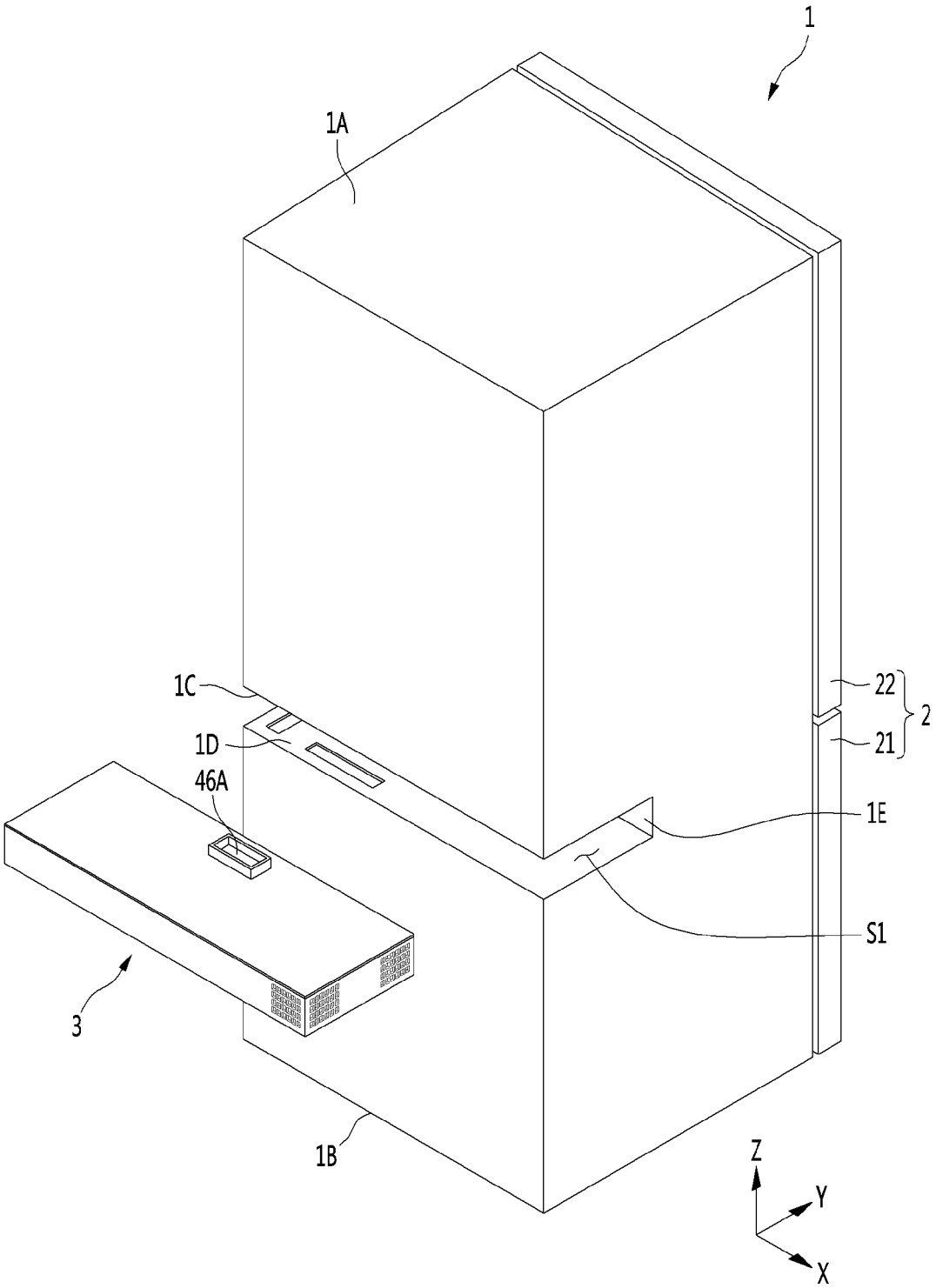

【Figure 4】
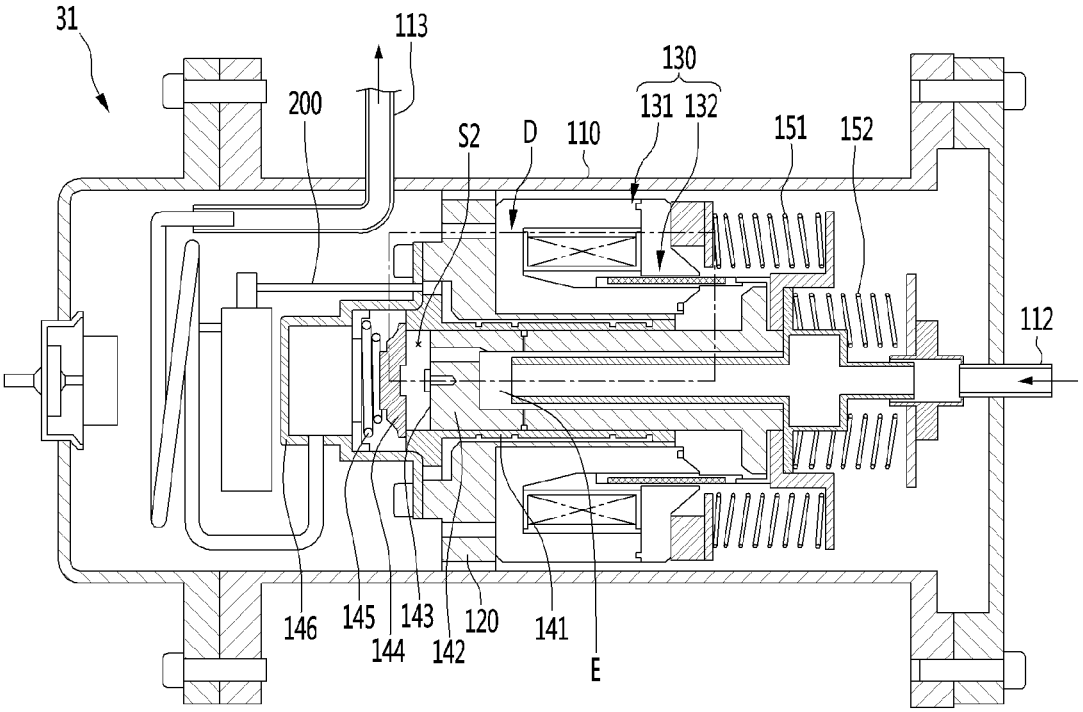

【Figure 5】
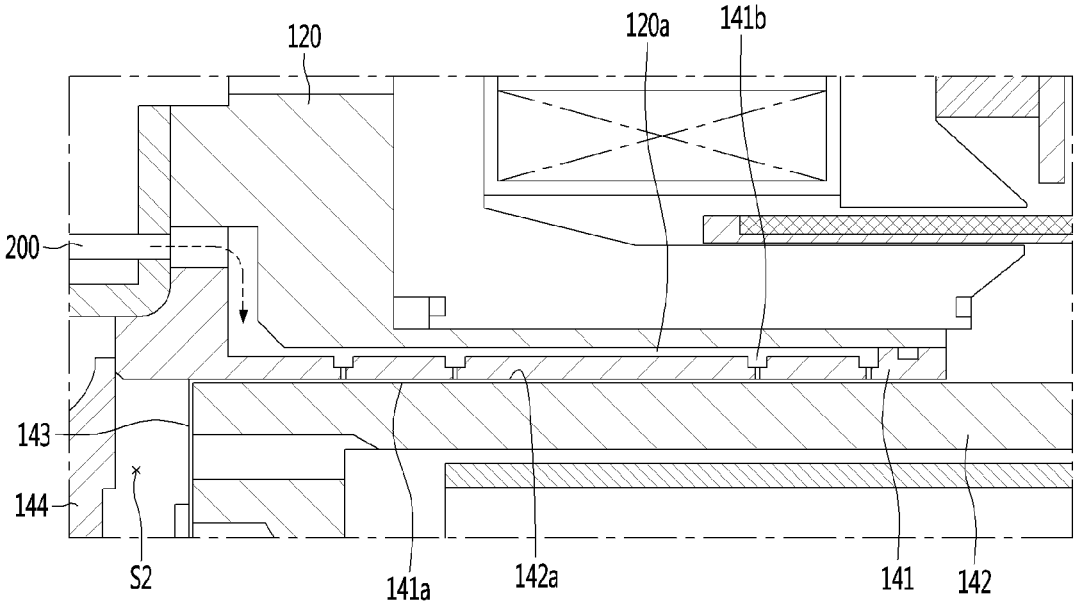

【Figure 6】
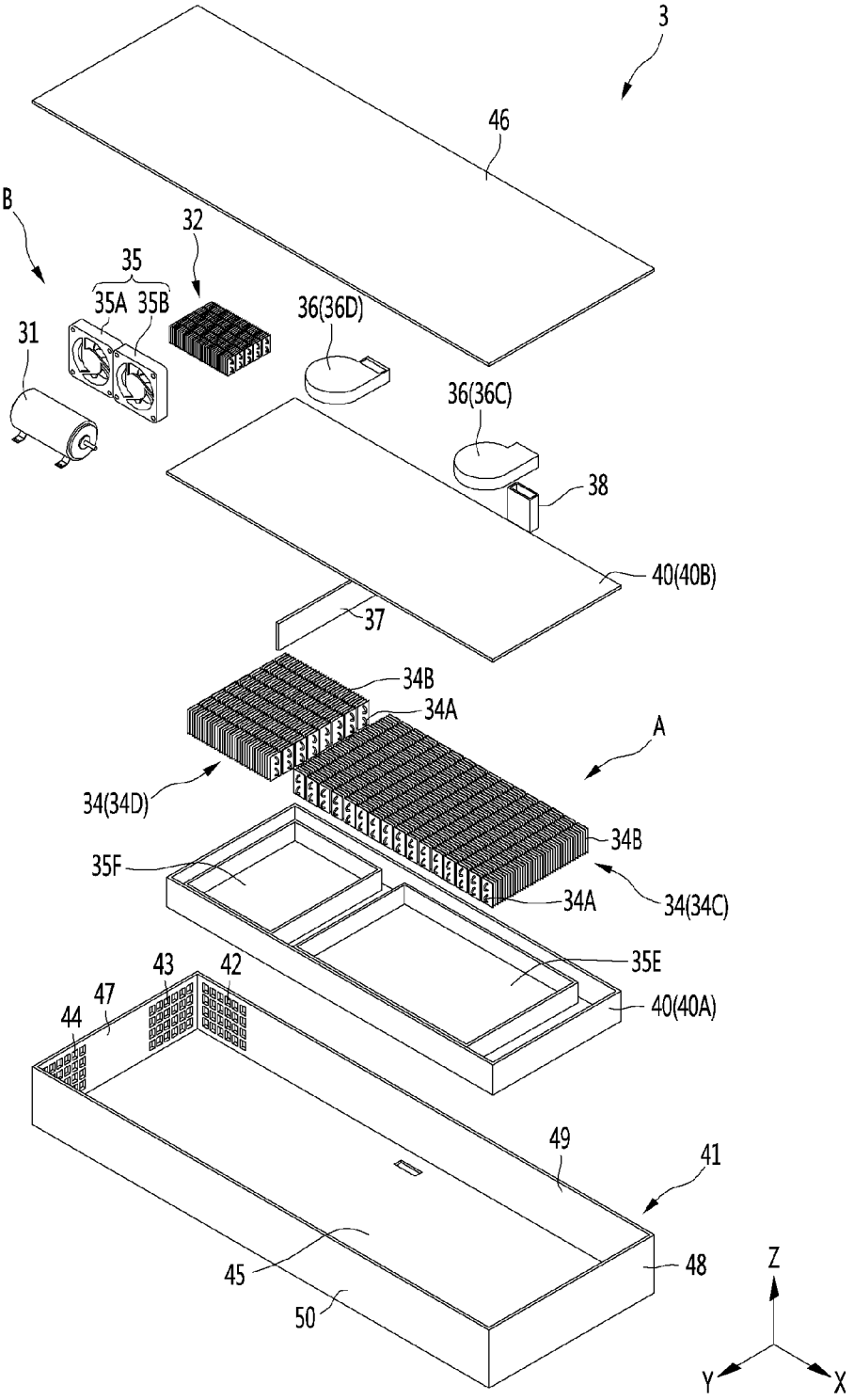

[Figure 7]
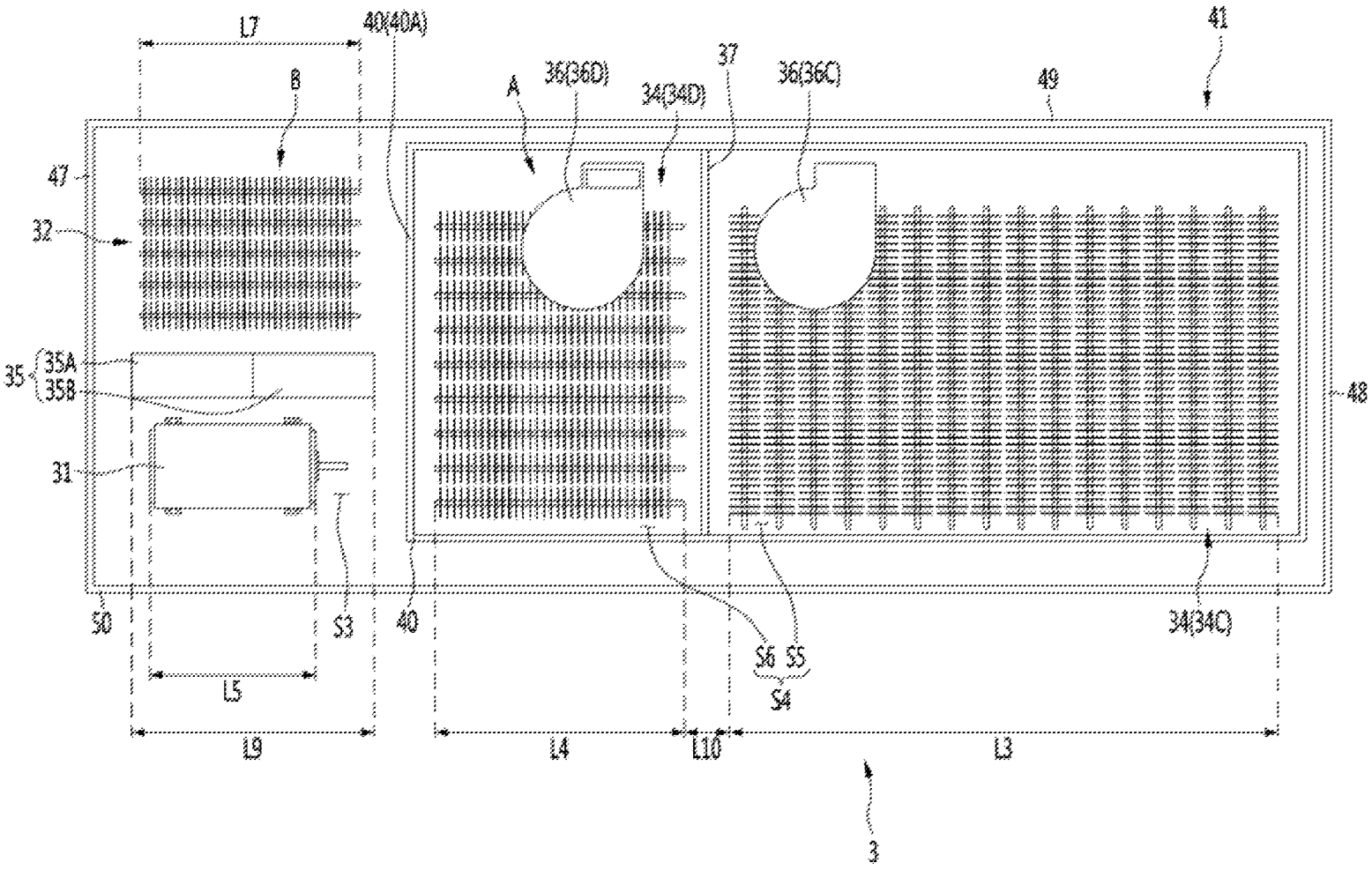

【Figure 8】
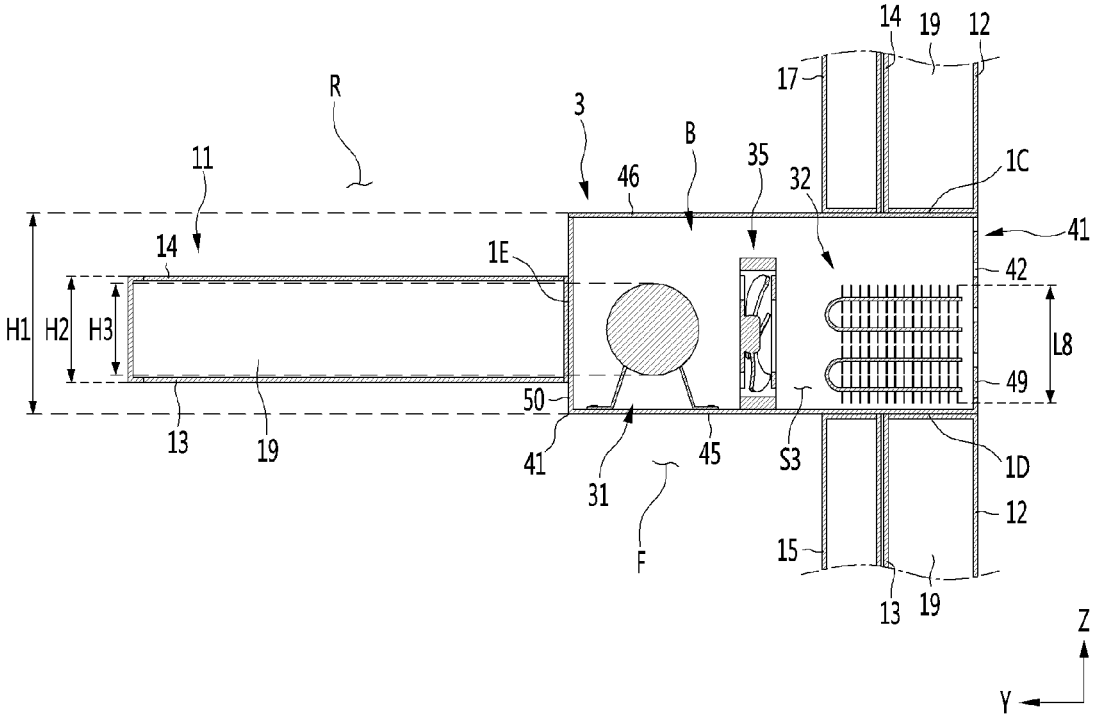

【Figure 9】
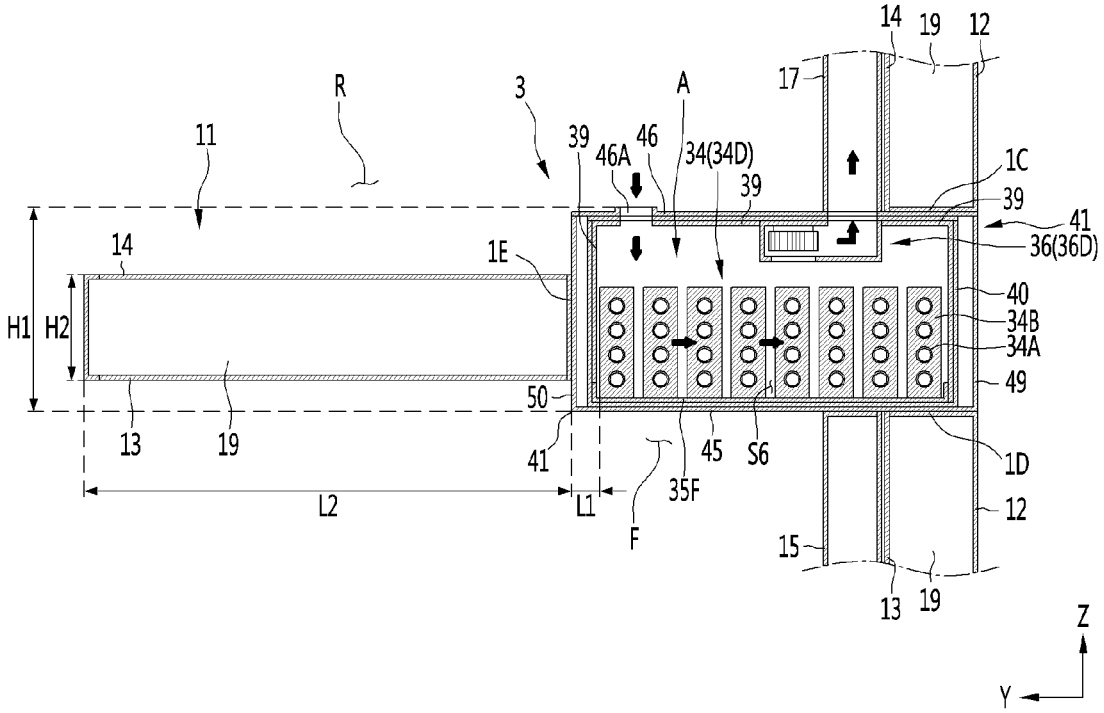

【Figure 10】
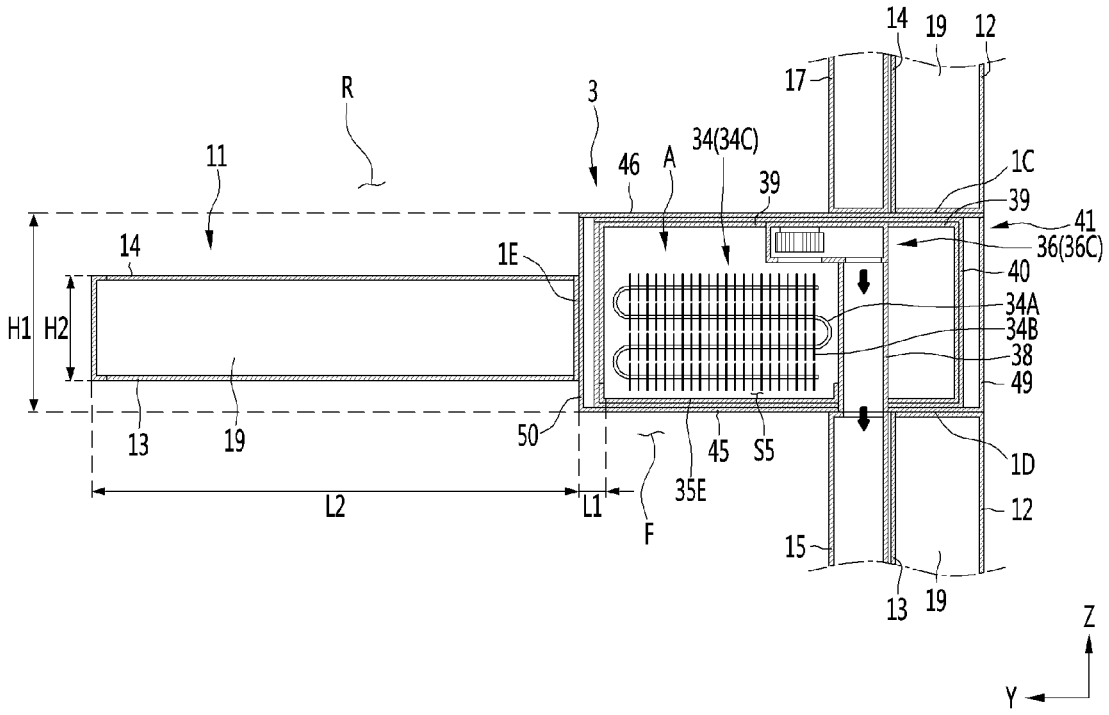

[Figure 11]
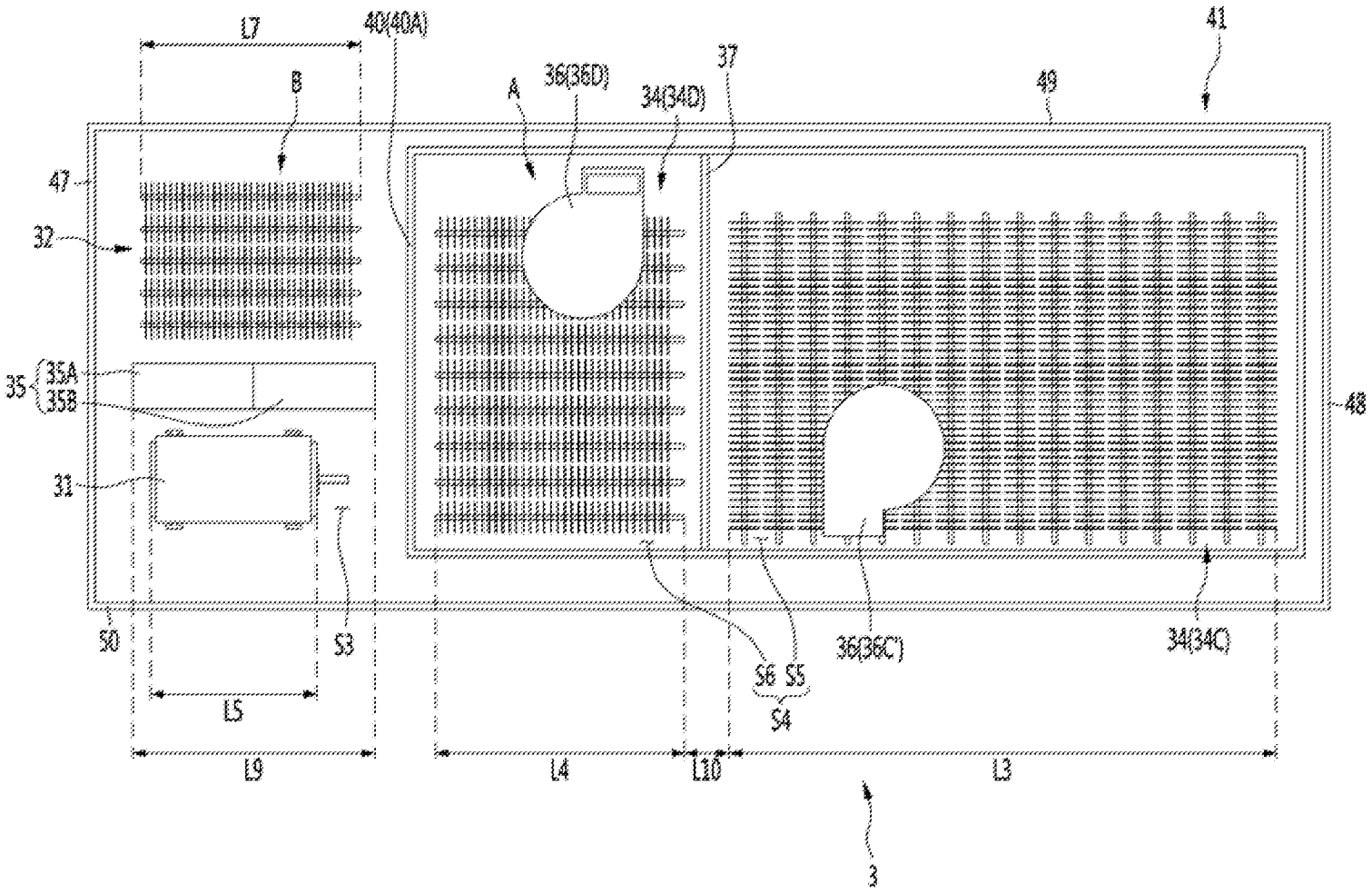

【Figure 12】
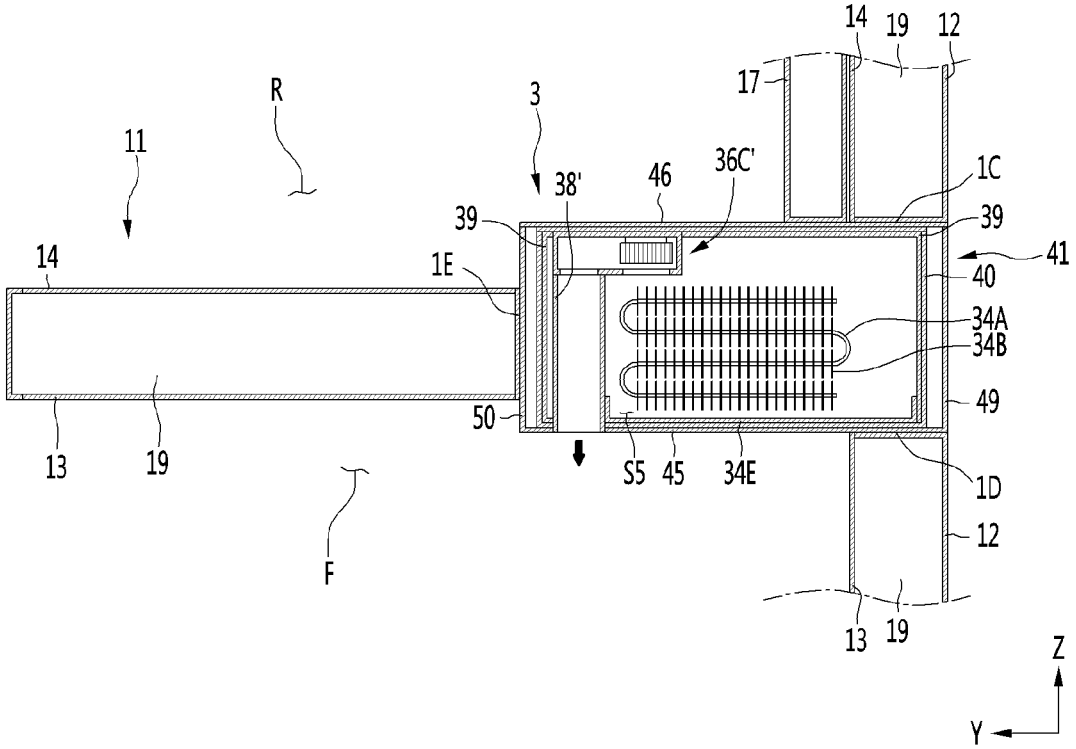

【Figure 13】
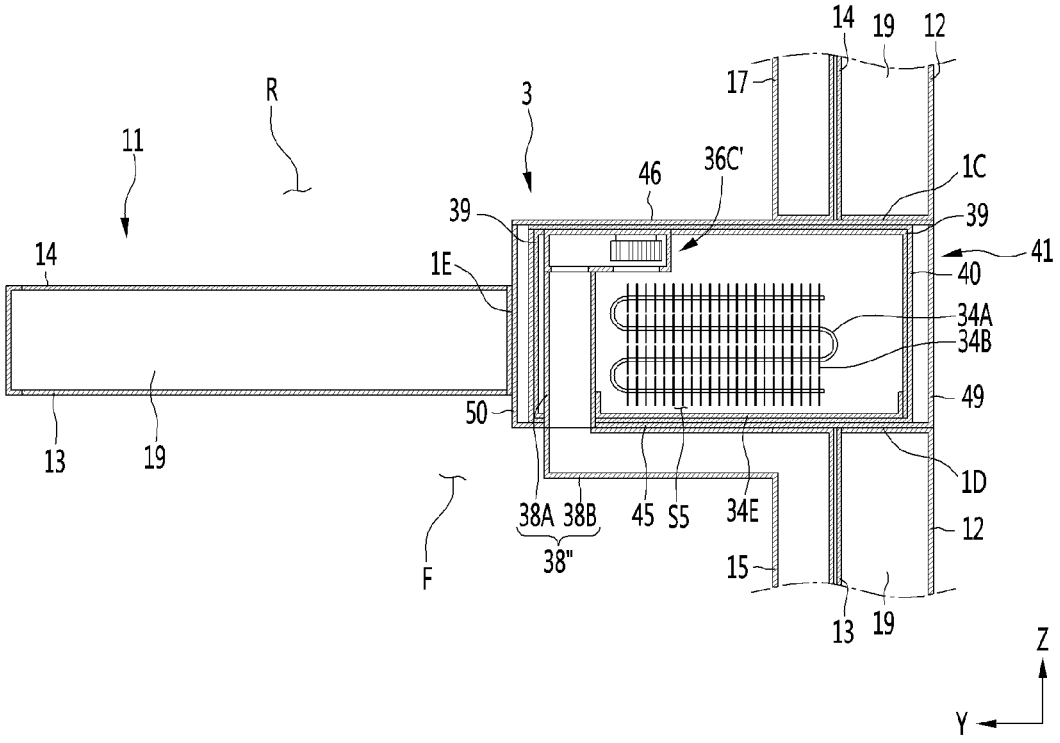

REFRIGERATOR

This application is a National Phase application of International Application No. PCT/KR2018/011075, filed on Sep. 19, 2018, and Korean Application No. 10-2017-0122584, filed on Sep. 22, 2017, all of which are hereby incorporated by reference in their entirety for all purposes as if fully set forth herein.

TECHNICAL FIELD

The present disclosure relates to a refrigerator, and more particularly, to a refrigerator having an evaporator for cooling a storage space such as a freezing space or a refrigerating space.

BACKGROUND ART

A refrigerator is an apparatus that prevents decay and deterioration by cooling objects to be cooled (hereinafter, referred to as food for convenience) such as food, medicine, and cosmetics or storing them at a low temperature.

The refrigerator includes a storage space in which food is stored and a refrigerant circulation apparatus for cooling the storage space. The refrigerant circulation apparatus may include a compressor, a condenser, an expansion device, and an evaporator through which refrigerant is circulated.

The refrigerator may include a freezing space maintained at a sub-zero temperature range and a refrigerating space maintained at an above-zero temperature range, and the freezing space or the refrigerating space may be cooled by at least one evaporator.

A refrigerator according to the related art may include an outer case and an inner case having a space formed inside the outer case and having a front opening, and further include a cold air discharge duct disposed in the inner case to divide the inside of the inner case into a storage space and a heat exchange chamber, and an evaporator and an evaporator fan disposed in the heat exchange chamber. In addition, such a refrigerator may be formed with a separate machine room outside the inner case and a compressor, a condenser and a condenser fan may be disposed in the machine room. The compressor in the machine room may be connected to an evaporator and a refrigerant tube in the heat exchange chamber.

Since, in the refrigerator according to the prior art as described above, the evaporator is disposed between the cold air discharge duct and an inner wall of the inner case, the volume of the storage space is reduced by the thickness of the evaporator in the front-rear direction, and it is hard to increase the capacity of the refrigerator.

In addition, the length of the refrigerant tube between the evaporator disposed inside the inner case and the evaporator disposed inside the machine room is greater than a distance between the evaporator and the compressor, and the installation process of the evaporator and the compressor is complicated.

Meanwhile, recent refrigerators may include a freezing space evaporator for cooling a freezing space and a refrigerating space evaporator for cooling a refrigerating space, and in this case, the installation of two evaporators is complicated, a length of the refrigerant tube connecting the two evaporators and the compressor is long, a process of connecting the two evaporator and the compressor is complicated.

DISCLOSURE

Technical Problem

An object of the present disclosure is to provide a refrigerator which is easy to connect a compressor and an evaporator and facilitate service such as repair or assembly.

Another object of the present disclosure is to provide a refrigerator in which a height of the refrigerator is not excessively high and a length of a refrigerant tube can be minimized.

Technical Solution

According to an embodiment of the present disclosure a refrigerator includes a body including at least one storage space having a front opening and formed with a cooling module accommodating space; a door configured to open and close the storage space; and, a cooling module accommodated in the cooling module accommodating space, and the cooling module includes a heat radiating part, a heat absorption part, and a cooling module barrier configured to separate the heat radiating part and the heat absorption part. The heat radiating part may include a compressor that compresses refrigerant, a condenser that condenses the refrigerant compressed by the compressor and a condenser fan that blows outdoor air to the condenser. The heat radiating part may be disposed eccentrically on one of lateral sides of the cooling module. The heat absorption part may include an evaporator that evaporates refrigerant and an evaporator fan that circulates cold air of the storage space to the evaporator and the storage space. The heat absorption may be disposed at a lateral side of the heat radiating part.

The body may include a body barrier configured to separate a freezing space and a refrigerating space, and the cooling module accommodating space may be formed to extend in a lateral direction on a rear side of the body barrier.

The cooling module may have a height higher than that of the body barrier.

At least one of the compressor, the evaporator and the condenser may face the body barrier in a front-rear direction.

The evaporator may be spaced apart from a rear end of the body barrier in a front-rear direction. A distance between a rear end of the body barrier and the evaporator may be shorter than a length of the body barrier in the front-rear direction.

The evaporator may be disposed to be laid horizontally.

The evaporator may include a refrigerant tube through which refrigerant passes, and at least one heat transfer fin connected to the refrigerant tube to allow the cold air to flow in a horizontal direction.

The evaporator may include a freezing space evaporator that cools the freezing space, and a refrigerating space evaporator that cools the refrigerating space. The cooling module may further include a heat absorption part barrier configured to separate the freezing space evaporator and the refrigerating space evaporator.

A length of the freezing space evaporator in the lateral direction may be greater than that of the refrigerating space evaporator in the lateral direction.

The refrigerating space evaporator may be disposed between the freezing space evaporator and the heat radiating part.

The heat absorption part may further include a heat absorption part insulating material to insulate the evaporator from the outside. The heat absorption part insulating material may be thinner than an insulating material of the body.

The condenser fan may be disposed in front of the condenser, the compressor may be disposed in front of the condenser fan, and the condenser fan may face the condenser and the compressor in the front-rear direction.

The cooling module may further include a cooling module body.

The cooling module body may be formed with an inlet through which outdoor air is sucked into the heat radiating part and an outlet through which air passing through the heat radiating part is discharged.

The cooling module body may include a rear body which surround the heat radiating part and a side body. The inlet may include a rear inlet formed in the rear body and a side inlet formed in the side body. The outlet may be spaced apart from the side inlet in the front-rear direction, in front of the side inlet of the side body.

A height of the compressor may be 0.8 times or less a length of the compressor in a horizontal direction. A length of the condenser in the horizontal direction is greater than a length of the condenser in a longitudinal direction.

A length of the condenser fan in a horizontal direction may be greater than that of the condenser in the horizontal direction, and is greater than that of the compressor in the horizontal direction.

The condenser fan may include a pair of fan units disposed in a lateral direction between the condenser and the compressor.

A cooling module body may form an outer surface of the cooling module and may be accommodated in the cooling module accommodating space.

The cooling module body may include a lower body and an upper body spaced apart from each other in a longitudinal direction; a pair of side bodies spaced apart from each other in a lateral direction, a rear body connecting rear portions of the pair of side bodies, a front body connecting front portions of the pair of side bodies.

The heat radiating part and the heat absorption part may be disposed between the pair of side bodies.

The evaporator fan may be a centrifugal fan in which a suction port is formed in at least one of a lower surface and an upper surface thereof, and in which a discharge port is formed in a portion other than the upper surface and the lower surface, and at least a portion of the centrifugal fan may be disposed over the evaporator to overlap the evaporator in the longitudinal direction.

The evaporator may include a freezing space evaporator that cools the freezing space, and a refrigerating space evaporator that cools the refrigerating space. The evaporator fan may include a freezing fan disposed above the freezing space evaporator, and a refrigerating fan disposed above the refrigerating space evaporator and spaced apart from the freezing fan in a horizontal direction.

The body may include an upper outlet duct, and the upper outlet duct may be disposed in a storage space located on a more upper side among the refrigerating space and the freezing space, and be formed with a plurality of upper discharge holes through which cold air blown from the heat absorption part is discharged.

The cooling module may be formed with an upper inlet through which cold air of a storage space located on a more upper side among the refrigerating space and the freezing space is sucked into the heat absorption part.

The refrigerator may include a lower inlet duct disposed in a storage space located on a more lower side among the refrigerating space and the freezing space. The lower inlet duct may be formed with a lower inlet through which cold air is sucked in a lower portion thereof and configured to guide cold air sucked into the lower inlet to the heat absorption part.

The body may include a lower outlet duct disposed in a storage space located on a more lower side among the refrigerating space and the freezing space. The lower outlet duct may be formed with a plurality of lower discharge holes for discharging cold air blown from the heat absorption part.

The cooling module may further include a connecting duct connecting a discharge port of one of the refrigerating fan and the freezing fan and the lower outlet duct.

The compressor may include a casing having an inner space; a reciprocating motor disposed in the inner space and having a stator and a mover; a cylinder having a cylinder side bearing surface on an inner circumferential surface thereof; a piston having a piston side bearing surface on an outer circumferential surface thereof and formed with a suction flow path through which refrigerant is sucked into the cylinder, the piston being connected to the mover so as to reciprocate with the mover; a suction valve provided in the piston to open and close the suction flow path; and a discharge valve provided in the cylinder to open and close a compression space formed between the cylinder and the piston, and the cylinder may be formed with a bearing hole for guiding gas between the cylinder side bearing surface and the piston side bearing surface therethrough. The compressor may have a length in a first direction, which is a movement direction of the piston, greater than a length in a second direction, orthogonal to the movement direction of the piston.

Each of the condenser fan and the condenser may have a length in the first direction greater than a length in the second direction.

A length of the cooling module accommodating space in the front-rear direction may be shorter than a length of the body in the front-rear direction.

The cooling module may be formed with an inlet through which outdoor air is sucked into the heat radiating part, and an outlet through which air passing through the heat radiating part is discharged.

The outlet of an example of the cooling module may be formed in at least one of the rear and side surfaces of the cooling module.

The inlet and outlet of another example of the cooling module may be formed in the rear surface of the cooling module.

A body has at least one storage space having a front opening and is formed with a cooling module accommodating space.

According to an aspect of the present disclosure, a refrigerator includes a body, a door, and a cooling module, wherein the cooling module includes a heat radiating part including a compressor, a condenser, and a condenser fan; and a heat absorption part including an evaporator in which refrigerant is evaporated and disposed beside the heat radiating part; and a cooling module barrier configured to separate the heat radiating part and the heat absorption part.

The compressor may include a casing having an inner space; a reciprocating motor disposed in the inner space and having a stator and a mover; a cylinder having a cylinder side bearing surface on an inner circumferential surface thereof; and a piston having a piston side bearing surface on an outer circumferential surface, connected to the mover to reciprocate with the mover, and formed with a suction flow path through which refrigerant is sucked and guided into the cylinder.

The compressor may include a suction valve provided in the piston to open and close the suction flow path; and a discharge valve provided in the cylinder to open and close a compression space formed between the cylinder and the piston, and the cylinder is formed with a bearing hole through which gas is guided into between the cylinder side bearing surface and the piston side bearing surface.

The compressor may have a length in a first direction, which is a movement direction of the piston, greater than a length in a second direction, orthogonal to the movement direction of the piston.

Each of the condenser fan and the condenser may be formed to have a length in the first direction greater than a length in the second direction.

The cooling module may be formed with an inlet through which outdoor air is sucked into the heat radiating part, and an outlet through which air passing through the heat radiating part is discharged, and the outlet may be formed in at least one of the rear and side surfaces of the cooling module.

The body includes a body barrier configured to separate the freezing space and the refrigerating space, and the length of the cooling module accommodating space in the front-rear direction may be shorter than that of the body in the front-rear direction.

The body may include a body barrier configured to separate the freezing space and the refrigerating space, and the height of the cooling module may be formed higher than the height of the body barrier.

According to another aspect of the present disclosure, the cooling module of the refrigerator may be formed with an inlet through which outdoor air is sucked into the heat radiating part and an outlet through which air passing through the heat radiating unit is discharged.

The body may include a body barrier configured to separate the freezing space and the refrigerating space, and the length of the cooling module accommodating space in the front-rear direction may be shorter than the length of the body in the front-rear direction.

The body may include a body barrier configured to separate the freezing space and the refrigerating space, and the height of the cooling module may be formed higher than the height of the body barrier.

Advantageous Effects

According to an embodiment of the present disclosure, there is an advantage in that the connection between the compressor and the evaporator is easy, and there is an advantage in that the service such as repair or assembly is easy.

In addition, since the cooling module is disposed at the rear of the body barrier that separates the freezing space and the refrigerating space, the volume of each of the freezing space and the refrigerating space can be maximized while the overall height of the refrigerator is not excessively increased, and the noise of the cooling module is minimized from being transmitted to the front of the refrigerator.

In addition, even when the height of the freezing space is different from that of the refrigerating space, the cooling module may be close to both the freezing space and the refrigerating space, thus minimizing the length of a cold air circulation passage, and cooling each of the freezing space and the refrigerating space more quickly.

In addition, it is possible to minimize the height of the cooling module accommodating space, thus minimizing the reduction in the volume of the storage space due to the cooling module.

In addition, there is an advantage that the compressor, the condenser and the evaporator can make the cooling module as compact as possible.

In addition, there is an advantage that the body barrier may minimize transmission of the noise of at least one of the compressor, the condenser fan or the evaporator fan in the front direction.

In addition, the heat absorption part barrier may prevent the mixing of cold air between the freezing space evaporator and the refrigerating space evaporator disposed close to each other, thus optimally controlling the temperature of each of the freezing space and the refrigerating space having a temperature difference.

In addition, the refrigerating space evaporator having a short length in the lateral direction is located between the freezing space evaporator and the heat radiating part of which the lengths are long in the lateral direction so that a portion of the freezing space evaporator and the refrigerating space evaporator may be positioned as close to the center of the refrigerator as possible, thereby supplying cold air to the freezing space and the refrigerating space evenly.

In addition, the compressor and the condenser fan in which noise occurs may be spaced apart from the front of the refrigerator and the rear of the refrigerator as much as possible, thereby minimizing the transmission of noise to the outside through the front of the refrigerator or the rear of the refrigerator.

In addition, outdoor air may be quickly sucked into the heat radiating part through the rear inlet and the side inlet, and then heat exchanged with the condenser, and the outdoor air which achieves heat radiation of the condenser and the compressor is discharged to the side of the refrigerator through the side outlet, thereby enabling the refrigerator to be placed closer to a wall.

In addition, since the height of the compressor is 0.8 times or less of the length of the compressor in the horizontal direction, and the width of the condenser in the horizontal direction is greater than the width of the condenser in the longitudinal direction, it is possible to minimize the maximum height of the heat radiating part, and minimizing the overall height of the cooling module from increasing due to the heat radiating part.

In addition, since the condenser fan includes a pair of fan units disposed in the lateral direction, the total height of the condenser fan may be reduced than when the condenser fan is composed of one large fan unit and the outdoor air may enable heat radiation of the condenser and the compressor, thus achieving high heat radiation performance of the heat radiating part.

In addition, the evaporator fan is composed of a centrifugal fan which is disposed overlapping the evaporator over the evaporator and laid horizontally, thereby minimizing the overall height of the heat absorption part.

DESCRIPTION OF DRAWINGS

FIG. 1 is a front view showing a storage space of a refrigerator according to an embodiment of the present disclosure.

FIG. 2 is a perspective view showing a rear surface of the refrigerator shown in FIG. 1.

FIG. 3 is a perspective view of the cooling module shown in FIG. 2 when being separated from a body.

FIG. 4 is a longitudinal sectional view showing a compressor according to an embodiment of the present disclosure.

FIG. 5 is an enlarged view showing a "D" portion shown in FIG. 4.

FIG. 6 is an exploded perspective view showing a cooling module according to an embodiment of the present disclosure.

FIG. 7 is a plan view showing the inside of a cooling module according to an embodiment of the present disclosure.

FIG. 8 is a cross-sectional view taken along line A-A shown in FIG. 1.

FIG. 9 is a cross-sectional view taken along line B-B shown in FIG. 1.

FIG. 10 is a cross-sectional view taken along line C-C shown in FIG. 1.

FIG. 11 is a plan view showing a cooling module according to another embodiment of the present disclosure.

FIG. 12 is a cross-sectional view showing a freezing space evaporator and a freezing space according to another embodiment of the present disclosure.

FIG. 13 is a cross-sectional view showing a freezing space evaporator and a freezing space according to still another embodiment of the present disclosure.

BEST MODE

FIG. 1 is a front view showing a storage space of a refrigerator according to an embodiment of the present disclosure, FIG. 2 is a perspective view showing a rear surface of the refrigerator shown in FIG. 1, and FIG. 3 is a perspective view of the cooling module shown in FIG. 2 when being separated from a body.

A refrigerator of the present embodiment may include a body 1, a door 2, and a cooling module 3. At least one storage space may be formed in the body 1. The storage space of the body 1 may have a front opening. The body 1 may include a body barrier 11. The body 1 may be formed with a plurality of storage spaces separated by the body barrier 11.

The body 1 may be formed with a freezing space F and a refrigerating space R. The body barrier 11 may be disposed between the freezing space F and the refrigerating space R, and the body barrier 11 may separate freezing space F and the refrigerating space R to be independent cooling spaces.

An example of the body barrier 11 may be arranged horizontally, as shown in FIG. 1. In this case, the body barrier 11 may separate the freezing space F and the refrigerating space R up and down, and one of the freezing space F and the refrigerating space R may be disposed above the body barrier 11 and the other one of the freezing space F and the refrigerating space R may be disposed below the body barrier 11.

Another example of the body barrier 11 may be arranged vertically. In this case, the body barrier 11 may separate the freezing space F and the refrigerating space R in the lateral direction, and one of the freezing space F and the refrigerating space R may be disposed on the left side of the body barrier 11 and the other one of the freezing space F and the refrigerating space R may be disposed on the right side of the body barrier 11.

Hereinafter, a description will be given by taking, as an example, a case in which the body barrier 11 may be formed to be horizontal to the body 1, and may separate the body 1 into the freezing space F and the refrigerating space R up and down.

The body 1 may include an outer case 12 forming an outer surface of the body 1. The outer case 12 may have a hexahedron shape as a whole. The body 1 may include a freezing space inner case 13 having the freezing space F therein and a refrigerating space inner case 14 having the refrigerating space R therein. Each of the freezing space inner case 13 and the refrigerating space inner case 14 may have a front opening, and may have a hexahedron shape having an upper plate, a lower plate, a left plate, a right plate, and a rear plate.

When the freezing space F is located below the refrigerating space R, the top plate of the freezing space F, the bottom plate of the refrigerating space R, and an insulating material 19 (see FIGS. 8 to 10) between the top plate of the freezing space F and the bottom plate of the refrigerating space R may constitute a body barrier 11.

Meanwhile, as illustrated in FIGS. 2 and 3, the body 1 may be formed with a cooling module accommodating space S1 in which the cooling module 3 is accommodated. The cooling module accommodating space S1 may not be formed at the front, upper and lower surfaces of the body 1, and may be formed at a height between the upper end 1A and the lower end 1B of the body 1. The cooling module accommodating space S1 may have a shape of which upper, lower and front surfaces thereof are blocked.

As shown in FIG. 3, the cooling module accommodating space S1 may be formed in a shape recessed in a forward direction on the rear surface of the body 1. The cooling module accommodating space S1 may be open to at least one of the left and right surfaces of the body 1 and the rear surface of the body 1. The cooling module accommodating space S1 may have a shape of which the rear surface and both side surfaces are open.

When the cooling module 3 is accommodated in the cooling module accommodating space S1, as shown in FIG. 2, a part of the cooling module 3 may be exposed to the outside. The cooling module accommodating space S1 may be located at the rear side of the body 1. When the body 1 is divided into a front part and a rear part with respect to the center of the front-rear direction of the body 1, the cooling module accommodating space S1 may be located in the rear part.

The body 1 may include an upper-side facing surface 1C positioned on the upper side of the cooling module 3 to face the upper surface of the cooling module 3, a lower-side facing surface 1D positioned on the lower side of the cooling module 3 to face the lower surface of the cooling module 3, and a front-side facing surface 1E positioned in front of the cooling module 3 to face the front surface of the cooling module 3.

The cooling module accommodating space S1 may have a substantially rectangular parallelepiped shape. In addition, a length of the cooling module accommodating space S1 in the front-rear direction Y may be shorter than the length of the body 1 in the front-rear direction Y.

The length of the cooling module accommodating space S1 in the lateral direction X may be greater than the length of the cooling module accommodating space S1 in the longitudinal direction Z and the length of the cooling module accommodating space S1 in the front-rear direction Y. The length of the cooling module accommodating space S1 in the front-rear direction Y may be greater than the length of the cooling module accommodating space S1 in the longitudinal direction Z. In addition, the cooling module accommodating space S1 may be formed to extend in the lateral direction X on the rear side the body barrier 11.

The door 2 may be arranged to open and close the storage space. The door 2 may be rotatably connected to the body 1 or slidably connected to the body 1. The door 2 may include a plurality of doors 21 and 22, and the plurality of doors 21 and 22 may include a freezing space door 21 that opens and closes the freezing space F and a refrigerating space door 22 that opens or closes the refrigerating space R.

The cooling module 3 may absorb heat of air flowing in the storage space using refrigerant and then radiate heat to outdoor air, and may be a refrigerant circulation apparatus. The cooling module 3 may include a heat absorption part A (see FIG. 7) that absorbs heat of air in the storage space, and a heat radiating part B (see FIG. 7) that radiates heat to outdoor air.

The cooling module 3 may be accommodated in the cooling module accommodating space S1 of the body 1. The cooling module 3 may communicate with the storage space in a state in which the cooling module 3 is mounted on the body 1 and may absorb heat of air in the storage space. The cooling module 3 may radiate heat to outdoor air sucked from the outside of the cooling module 3.

The cooling module 3 may be disposed at the rear side of the body barrier 11, and in this case, the volume of each of the freezing space and the refrigerating space may be maximized, and the total height of the refrigerator may not be excessively high. Furthermore, noise of the cooling module 3 may be minimized to be transferred to the front side of the refrigerator.

When the cooling module 3 is disposed at the rear side of the body barrier 11, at least a portion of the cooling module 3 may face the body barrier 11 in the horizontal direction. The cooling module 3 may be located on the rear side the body barrier 11 in the front-rear direction Y, and at least a portion thereof may face the rear surface of the body barrier 11 in the front-rear direction Y. Here, the rear surface of the body barrier 11 may be a front-side facing surface 1E of the body barrier 11 disposed in front of the cooling module 3 and facing the front surface of the cooling module 3.

Meanwhile, as shown in FIG. 1, the body 1 may further include a lower outlet duct 15, a lower inlet duct 16, and an upper outlet duct 17.

The lower outlet duct 15 may be disposed inside a storage space (hereinafter, referred to as a lower storage space) located further below among the freezing chamber F and the refrigerating space R. The lower outlet duct 15 may be provided with a plurality of lower discharge holes 15A for discharging cold air blown from the heat absorption part A (see FIG. 7) to the lower storage space.

The lower outlet duct 15 may be disposed closer to the rear plate of the inner case forming the lower storage space than the front opening of the lower storage space.

The lower inlet duct 16 may be disposed inside a storage space (that is, the lower storage space) located on the further lower side among the freezing space F refrigerating space R. The lower inlet duct 16 may be formed with a lower inlet 16A, through which cold air is sucked, in the lower portion thereof. The lower inlet duct 16A may guide the cold air sucked into the lower inlet 16A to the heat absorption part A. The lower inlet duct 16 may be disposed closer to any one of the left and right plates of the inner case forming the lower storage space. The lower inlet duct 16 may be disposed closer to a side plate closer to the heat absorption part A among the left and right plates of the inner case forming the lower storage space.

The upper outlet duct 17 may be disposed inside a storage space (hereinafter referred to as an upper storage space) that is located on the more upper side among the freezing space F and the refrigerating space R. The upper outlet duct 17 may be formed with a plurality of upper discharge holes 17A for discharging cold air blown from the heat absorption part A (see FIG. 7) of the cooling module 3 to the upper storage space. In addition, the upper outlet duct 17 may be disposed closer to the rear plate of the inner case forming the upper storage space than the front opening of the upper storage space.

The lower inlet duct 16 may suck cold air from the lower storage space to guide cold air to the heat absorption part A, and air blown after being cooled in the heat absorption part A may be discharged to the lower storage space through the lower outlet duct 16. Meanwhile, the air blown from the heat absorption part A may be discharged to the upper storage space through the upper outlet duct 17.

When the cooling module 3 is located on the rear side of the body barrier 11 as described above, the cooling module 3 may be as close as possible to both the lower storage space and the upper storage space, and quickly cool the lower and upper spaces at positions close to the lower storage space and the upper storage space, respectively.

The cooling module 3 as described above may include a compressor 31 (see FIG. 4) for compressing gas refrigerant.

FIG. 4 is a longitudinal cross-sectional view showing a compressor according to an embodiment of the present disclosure, FIG. 5 is an enlarged view showing a "D" portion shown in FIG. 4.

The compressor 31 of the present embodiment may be a reciprocating compressor in which a piston 142 reciprocates in a cylinder 141 and may be a compressor in which gas introduced between the piston 142 and the cylinder 141 may be substituted for a lubricant such as oil.

To this end, a cylinder side bearing surface 141*a* may be formed on the inner circumferential surface of the cylinder 141, a piston side bearing surface 142*a* may be formed on the outer circumferential surface of the piston 142, and the cylinder 141 may be formed with a bearing hole 141*b* for guiding gas to between the cylinder side bearing surface 141*a* and the piston side bearing surface 142*a*.

As described above, the gas guided to the cylinder side bearing surface 141*a* and the piston side bearing surface 142*a* may be lubricated like oil.

The compressor 31 as described above does not need an oil supply device for supplying oil between the piston 142 and the cylinder 141, and does not need to form a separate space for accommodating oil in the compressor 31. When the compressor 31 does not include an oil supply device, the structure thereof may be simplified, the overall size of the compressor may be minimized, and the compressor may be miniaturized.

As described above, the compressor 31 that does not require an oil supply device may enhance space availability around the heat radiating part B, in particular, the compressor 31, and the cooling module 3 may be compact.

Hereinafter, the compressor 31 will be described below in detail.

The compressor 31 may include a casing 110, a reciprocating motor 130, a cylinder 141, and a piston 142. The casing 110 may form an outer surface of the compressor 31. The casing 110 may have an inner space.

The casing 110 may be provided with a suction pipe 112 that guides refrigerant into the casing 110. The suction pipe 112 may be connected to the casing 110 such that one end thereof is positioned in the inner space of the casing 110. The casing 110 may be provided with a discharge tube 113 for guiding the compressed refrigerant to the outside. The discharge tube 113 may be connected to the casing 110 such that one end thereof is positioned inside the casing 110.

A frame 120 supporting the reciprocating motor 130 and the cylinder 41 may be disposed in the casing 110. The reciprocating motor 130 may be disposed in the inner space.

The reciprocating motor 130 may have a stator 131 and a mover 132. The stator 131 may include a stator and a coil coupled to the stator, and the mover 132 may include a magnet reciprocating by the stator 131, and a magnet holder to which the magnet is fixed.

The cylinder 141 may be formed with a space in which the piston 142 may reciprocate. The cylinder side bearing surface 141*a* may be formed on the inner circumferential surface of the cylinder 141.

The piston 142 may be connected to the mover 132 to reciprocate with the mover 132. The piston 142 may be formed with a suction flow path E through which the refrigerant is suctioned and guided into the cylinder 141. A compression space S2 in which refrigerant passing through the suction flow path E is compressed may be formed between the piston 142 and the cylinder 141.

The piston 142 may include one end forming the compression space S2 together with the cylinder 141, and one end of the piston 142 may be formed with a through hole through which the refrigerant of the suction flow path E is guided to the compression space S2. The suction flow path E may be formed in the same direction as the reciprocating direction of the piston 142 in the piston 142. The suction flow path E may be formed to extend in the longitudinal direction of the piston 142.

The piston side bearing surface 142*a* facing the cylinder side bearing surface 141*a* may be formed on the outer circumferential surface of the piston 142. The cylinder side bearing surface 141*a* and the piston side bearing surface 142*a* may be formed to face each other, and when gas flows in between the cylinder side bearing surface 141*a* and the piston side bearing surface 142*a*, the cylinder side bearing surface 141*a* and the piston side bearing surface 142*a* may function as gas bearing.

The compressor 31 may guide the gas refrigerant compressed in the compression space S2 to flow between the cylinder side bearing surface 141*a* and the piston side bearing surface 142*a*. To this end, a bearing hole 141*b* for guiding the gas refrigerant compressed in the compression space S2 to between the cylinder side bearing surface 141*a* and the piston side bearing surface 142*a* may be formed in the cylinder 141.

On the other hand, the compressor 31 may further include a suction valve 143 provided in the piston 142 to open and close the suction flow path E, and a discharge valve 144 provided in the cylinder 141 to open and close the compression space S2 formed between the cylinder 141 and the piston 142.

The compressor 31 may further include a discharge cover 146 having a space in which the discharge valve 144 is accommodated, and a spring 147 disposed inside the discharge cover 146 to press the discharge valve 144 in the direction of the piston 142. The discharge tube 113 may be connected to the discharge cover 146, and gas refrigerant introduced into the discharge cover 146 when the discharge valve 144 is opened may be guided to the outside of the compressor 31 through the discharge tube 113.

In addition, the compressor 31 may further include resonant springs 151 and 152 for inducing resonant movement of the piston 142 so as to reduce vibration and noise occurrence caused by the movement of the piston 142.

In one example of the compressor 31 that does not require an oil supply device, the gas in the compression space S2 may be directly introduced into the bearing hole 141*b*, pass through the bearing hole 141*b*, and then flow in between the cylinder side bearing surface 141*a* and the piston side bearing surface 142*a*. In this case, the bearing hole 141*b* may be formed such that one end thereof faces the compression space S2 and the other end thereof faces the piston side bearing surface 142*a*.

In another example of the compressor 31 that does not require an oil supply device, gas flowing through the discharge tube 113 after being compressed in the compression space S2 or gas in the discharge cover 146 may pass through a gas guide unit 200 and a gas channel 120*a* formed in the frame 120 sequentially and be then guided to the bearing hole 141*b*, and gas guided to the bearing hole 141*b* may pass through the bearing hole 141*b* and be then introduced to between the cylinder side bearing surface 141*a* and the piston side bearing surface 142*a*.

The gas guide unit 200 may include a gas pipe for guiding gas of the discharge pipe 113 or the discharge cover 146 to the gas channel 120*a*. One end of the gas pipe may be connected to the discharge pipe 113, and the other end thereof may be connected to the gas channel 120*a*. In addition, the bearing hole 141*b* may be formed such that one end of the bearing hole 141*b* faces the gas channel 120*a* and the other end faces the piston side bearing surface 142*a*.

In the compressor 31 as described above, when power is applied to the reciprocating motor 130, the mover 132 reciprocates with respect to the stator 131. The piston 142 coupled to the mover 132 reciprocates linearly inside the cylinder 141, the gas refrigerant of the suction pipe 112 is sucked into the compression space S2 through the suction flow path E and compressed, and the compressed gas refrigerant is discharged through the discharge pipe 113.

During operation of the compressor 31 as described above, a part of the gas refrigerant compressed in the compression space S2 may pass through the bearing hole 141*b* and may be then introduced to between the cylinder side bearing surface 141*a* and the piston side bearing surface 142*a*, thereby minimizing a friction force between the piston 142 and the cylinder 141.

FIG. 6 is an exploded perspective view showing a cooling module according to an embodiment of the present disclosure, FIG. 7 is a plan view showing the inside of a cooling module according to an embodiment of the present disclosure, FIG. 8 is a cross-sectional view taken along line A-A shown in FIG. 1, FIG. 9 is a cross-sectional view taken along line B-B shown in FIG. 1, and FIG. 10 is a cross-sectional view taken along line C-C shown in FIG. 1.

The cooling module 3 may include a compressor 31 through which refrigerant circulates, a condenser 32, an expansion device (not shown), and an evaporator 34. The compressor 31 may compress refrigerant flowing in the evaporator 34. The condenser 32 may condense the refrigerant compressed by the compressor 31 by perform heat exchange with outdoor air. The expansion device is to decompress the refrigerant condensed in the condenser 32, may be composed of an electronic expansion valve such as LEV or EEV, or may be composed of a capillary tube.

The cooling module 3 may further include a condenser fan 35 for blowing outdoor air to the condenser 32. The compressor 31 may be located adjacent to the condenser 32, and the condenser fan 35 may blow outdoor air to the condenser 32 and the compressor 31. The outdoor air of the present specification is air outside the refrigerator sucked into the heat radiating part B in a room where the refrigerator is installed.

The evaporator 34 may evaporate the refrigerant decompressed by the expansion device by performing heat exchange with cold air flowing in the storage space. At least one evaporator 34 may be provided in the cooling module 3. The cooling module 3 may further include an evaporator fan 36 which circulates cold air in the storage space to the evaporator 34 and the storage space.

The compressor 31, the condenser 32, and the condenser fan 35 may constitute a heat radiating part B that radiates heat to outdoor air. As shown in FIG. 7, the heat radiating part B may be disposed eccentrically on one side of the left and right sides of the cooling module 3.

The evaporator 34 and the evaporator fan 36 may constitute a heat absorption part A for absorbing heat of air of the storage space. The heat absorption part A may be disposed beside the heat radiating part B, as shown in FIG. 7. The refrigerator may have a hexahedral shape as a whole, and the heat radiating part B and the heat absorption part A may be disposed left and right. The heat radiating part B and the heat absorption part A may be spaced apart in the lateral direction X.

In the refrigerator of the present embodiment, the compressor 31, the condenser 32, the expansion device, and the evaporator 34, which constitute a refrigerant circulation apparatus, may all constitute the cooling module 3, and a refrigerant tubes for guiding the refrigerant may be disposed only within the cooling module 3. That is, a refrigerant tube connecting the compressor 31 and the condenser 32, a refrigerant tube connecting the condenser 32 and the expansion device, a refrigerant tube connecting the expansion device and the evaporator 34, and a refrigerant tube connecting the evaporator 34 and the compressor 31 all may be disposed inside the cooling module 3.

When the refrigerant tubes as described above are arranged only in the cooling module 3, the refrigerant tubes do not need to be disposed in the body 1, in particular, the storage space, and a refrigerant tube through hole or a refrigerant tube guide through which the refrigerant tubes pass are not required.

When the evaporator is disposed inside the inner case forming the storage space and the refrigerant tube passes through the inner case, the manufacturing process of the body 1 may be complicated, and the refrigerant tube connecting operation may be complicated.

However, when the evaporator 34 is positioned outside the inner case forming the storage space as in the present disclosure, the body 1 does not need to be provided with a refrigerant tube through hole or a refrigerant tube guide and fabrication of the body 1 and installation of the evaporator 34 may be easy.

As the present disclosure, when the compressor 31, the condenser 32, and the evaporator 34 is arranged close to each other while forming one cooling module 3, the length of the refrigerant tube for guiding the refrigerant may be minimized and the manufacturing cost of the refrigerator may be reduced.

On the other hand, in the refrigerator, the heat radiating part B may be located in front of the heat absorption part A. In this case, however, the compressor 31, which is a part of the heat radiating part B, may be close to the front of the refrigerator, and the compressor 31 may be preferably located as far as possible from the front of the refrigerator.

As shown in FIG. 7, when the heat radiating part B is positioned beside the heat absorption part A, the compressor 31 constituting the heat radiating part B may be positioned as far as possible from the front of the refrigerator and the transmission of noise occurring in the compressor 31 to the front of the body 1 may be minimized.

That is, the heat radiating part B may be preferably located closer to the rear surface of the body 1 than the front surface of the body 1 and the heat absorption part A may be preferably located beside the heat radiating part B to minimize the size of the cooling module 3, in particular, a length of the cooling module 3 in the front-rear direction Y and the length of the cooling module 3 in the longitudinal direction Z.

As in the present embodiment, when the heat absorption part A is positioned beside the heat radiating part B, at least one of the compressor 31, the evaporator 34, and the condenser 32 may face the body barrier 11 in the front-rear direction Y. A virtual extending surface extending in the horizontal direction from the rear end of the body barrier 11 may meet the compressor 31, the evaporator 34, and the condenser 32, respectively, and the compressor 31 may overlap the body barrier 11 in the horizontal direction.

The cooling module 3 may be configured such that cold air flowing in the storage space flows to the heat absorption part A, and outdoor air flows to the heat radiating part B. To this end, the cooling module 3 may include a cooling module barrier 40 which separates the heat radiating part B and the heat absorption part A.

As shown in FIG. 7, the cooling module barrier 40 may partition the inside of the cooling module 3 into a space S3 in which the heat radiating part B is accommodated, and a space S4 in which the heat absorption part A is accommodated.

An example of the cooling module barrier 40 may be composed of a partition plate disposed between the heat radiating part B and the heat absorption part A, thus enabling partition into the heat radiating part B and the heat absorption part A left and right. In this case, the cooling module barrier 40 may be disposed to extend in the front-rear direction Y inside the cooling module 3.

Another example of the cooling module barrier 40 may be composed of an evaporator housing disposed outside the heat absorption part A to surround the heat absorption part A, or may separate the heat radiating part B inside the evaporator housing and the heat absorption part A outside the evaporator housing. In this case, a heat absorption part accommodating space S4 in which the heat absorption part A is accommodated may be formed inside the cooling module barrier 40. The heat radiating part accommodating space S3 in which the heat radiating part B is accommodated may be located outside the cooling module barrier 40.

The cooling module barrier 40 may be formed in a substantially hexahedral shape, and a heat absorption part accommodating space S4 may be formed therein. The cooling module barrier 40 may have a long hexahedral shape in the lateral direction X, and the length of the cooling module barrier 40 in the lateral directions X may be greater than the length of the cooling module barrier 40 in the front-rear direction Y and the length of the cooling module barrier 40 in the longitudinal direction Z.

When the cooling module barrier 40 is formed in a hexahedral shape, the cooling module barrier 40 may include a barrier housing 40A having an open upper surface, and a barrier top cover 40B covering the upper surface of the barrier housing 40A.

The cooling module 3 may preferably secure the maximum space for accommodating the evaporator 34 and the total length of the evaporator 34 the lateral direction X may preferably exceed the half (½) of the length of the body 1 in the lateral direction X. Here, when the evaporator 34 includes a freezing space evaporator 34C and a refrigerating space evaporator 34D, and the freezing space evaporator 34C and the refrigerating space evaporator 34D are spaced apart in the lateral direction X, the total length of the evaporator 34 in the lateral direction X may be the sum of the length L3 of the freezing space evaporator 34C in the lateral direction X, a separation distance L10 between the freezing space evaporator 34C and the refrigerating space evaporator 34D, and the length L4 of the refrigerating space evaporator 34D in the lateral direction X and the total length (L3+L10+L4) of the evaporator 34 in the lateral direction X may be preferable to be as long as possible in the lateral direction X when it is possible to secure the width of the space S3 in the lateral direction X which is occupied by the heat radiating part B sufficiently.

On the other hand, as shown in FIG. 9, the height H1 of the cooling module 3 may be higher than the height H2 of the body barrier 11.

The height from the bottom of the body 1 to the bottom of the cooling module 3 may be lower than the height from the bottom of the body 1 to the bottom of the body barrier 11. In addition, the height from the bottom of the body 1 to the top of the cooling module 3 may be higher than the height from the bottom of the body 1 to the top of the body barrier 11.

In this case, the upper end and the lower end of the cooling module 3 do not overlap the rear surface of the body barrier 11 in the horizontal direction, and a portion between the upper end and lower end of the cooling module 3 may overlap overlap the rear surface of the body barrier 11 in the horizontal direction.

The cooling module 3 may further include a cooling module body 41. The cooling module body 41 may form an outer surface of the cooling module 3 and may be accommodated in the cooling module accommodating space S1. The cooling module body 41 may be accommodated in the cooling module accommodating space S1 together with the heat absorption part A and the heat radiating part B.

The cooling module 3 may be mounted in the cooling module accommodating space S1 in a state in which both the heat absorption part A and the heat radiating part B both are mounted in the cooling module body 41. On the other hand, in a state in which the cooling module body 41 of the cooling module 41 is mounted in the cooling module accommodating space S1, the heat absorption part A and the heat radiating part B may be mounted in the cooling module body 41. The assembly of the heat absorption part A, the heat radiating part B, and the cooling module body 41 may be manufactured separately from the body 1 and then mounted in the body 1.

The cooling module body 41 may include a lower body 45 and an upper body 46 spaced apart in the longitudinal direction, a pair of side bodies 47 and 48 spaced apart in the lateral direction, a rear body 49 connecting the rear portions of the pair of side bodies 47 and 48, and a front body 50 connecting the front portions of the pair of side bodies 47 and 48.

The heat radiating part B and the heat absorption part A may be disposed to be spaced apart from each other left and right between the pair of side bodies 47 and 48. The overall height H1 of the cooling module 3 may be determined by the height of the cooling module body 41.

The cooling module body 41 may have a portion of the outer surface thereof, which forms a storage space. In this case, an opening may be formed in at least one of the freezing space inner case 13 and the refrigerating space inner case 14, and the cooling module body 41 may be disposed to block the opening. In this case, the outer surface of the cooling module body 41 and the inner surface of the freezing space inner case 13 may form the freezing space F together. The outer surface of the cooling module body 41 and the inner surface of the refrigerating space inner case 14 may form the refrigerating space R together.

The cooling module body 41 may be positioned such that one of a part of an upper portion or a part of a lower portion thereof is inserted into the refrigerating space R to protrude into the refrigerating space R, and may be also positioned such that the other of the part of the upper portion or the part of the lower portion thereof may be inserted into the freezing space F to protrude into the freezing space F.

On the other hand, the body 1 may further include a separate cooling module cover (not shown) covering a portion protruding toward the refrigerating space R of the cooling module body 41 or a portion protruding toward the freezing chamber F of the cooling module body 41. In this case, the cooling module cover may form the freezing space F together with the inner surface of the freezing space inner case 13, and may form the refrigerating space R together with the refrigerating space inner case 14.

Hereinafter, the heat absorption part A will be described in detail.

As illustrated in FIGS. 9 and 10, the evaporator 34 may be spaced apart from the rear end 1E of the body barrier 11 in the front-rear direction Y.

The rear end 1E of the body barrier 11 may be the front-side facing surface 1E shown in FIG. 3. The separation distance L1 between the rear end 1E of the body barrier 11 and the evaporator 34 in the front-rear direction may be shorter than the length L2 of the body barrier 11 in the front-rear direction.

The evaporator 34 may be arranged to be laid horizontally. The evaporator 34 may include a refrigerant tube 34A through which refrigerant passes, and at least one heat transfer fin 34B coupled to the refrigerant tube 34A to guide cold air in the horizontal direction. The heat transfer fin 34B may be vertically disposed in a state of being connected to the refrigerant tube 34A.

The heat transfer fin 34B may guide air in the horizontal direction (that is, in a lateral direction or a front-rear direction) in a state of standing vertically. When the heat transfer fin 34B guides the cold air in the front-rear direction Y, the heat transfer fin 34B may include a left guide surface and a right guide surface that guide the cold air in the front-rear direction Y. When the heat transfer fin 34B guides the cold air in the lateral direction X, the heat transfer fin 34B may include a front guide surface and a rear guide surface that guide the cold air in the lateral direction X.

The evaporator 34 may include a freezing space evaporator 34C for cooling the freezing space F and a refrigerating space evaporator 34D for cooling the refrigerating space R. In this case, each of the freezing space evaporator 34C and the refrigerating space evaporator 34D may include a refrigerant tube 34A and at least one heat transfer fin 34B coupled to the refrigerant tube 34A.

The length L3 of the freezing space evaporator 34C in the lateral direction X may be greater than the length L4 of the refrigerating space evaporator 34D in the lateral direction X as shown in FIG. 7.

The refrigerating space evaporator 34D may be located between the freezing space evaporator 34C and the heat radiating part B.

The cooling module 3 may further include a heat absorption part barrier 37 that separates the freezing space evaporator 34C and the refrigerating space evaporator 34D. The heat absorption part barrier 37 may be disposed to extend in the front-rear direction Y, and may separate a first evaporator chamber S5 in which the freezing space evaporator 34C is accommodated and a second evaporator chamber S6 in which the refrigerating space evaporator 34D is accommodated as illustrated in FIG. 7. The heat absorption part barrier 37 may divide the heat absorption part accommodating space S4 into the first evaporator chamber S5 and the second evaporator chamber S6.

The freezing space evaporator 34C may face either side of the left and right sides of the heat absorption part barrier 37 in the horizontal direction, and the refrigerating space evaporator 34D may face the other side of the left and right sides of the heat absorption part barrier 37.

Any one of the left side and the right side of the heat absorption part barrier 37 may be a first cold air guide surface that guides cold air of the first evaporator chamber S5, and the other of the left side and the right side of the heat absorption part barrier 37 may be a second cold air guide surface that guides cold air of the second evaporator chamber S6.

The heat absorption part barrier 37 may guide cold air in cooperation with the cooling module barrier 40. The heat absorption part barrier 37 may be disposed to extend in the front-rear direction inside the cooling module barrier 40, and may divide the inside of the cooling module barrier 40 to the first evaporator chamber S5 and the second evaporator chamber S6 left and right.

The heat absorption part barrier 37 may be spaced apart from each of the freezing space evaporator 34C and the refrigerating space evaporator 34D in the lateral direction X. The heat absorption part barrier 37 may have a size larger than that of the second evaporator chamber S6. The heat absorption part barrier 37 may be disposed eccentrically to one of the left and right sides in the cooling module barrier 40. The heat absorption part barrier 37 may be disposed eccentrically in the direction of the heat radiating part B in the cooling module barrier 40.

The cooling module barrier 40 may include a pair of side covers, and a distance between one of the pair of side covers and the heat absorption part barrier 37 may be shorter than a distance between the other of the pair of side covers and the heat absorption part barrier 37.

The freezing space evaporator 34C may be accommodated in a larger evaporator chamber of the first evaporator chamber S5 and the second evaporator chamber S6, and the refrigerating space evaporator 34D may be accommodated in a smaller evaporator chamber of the first evaporator chamber S5 and the second evaporator chamber S6.

The heat absorption part A may further include a freezing drain pan 34E (see FIG. 10) disposed under the freezing space evaporator 34C to receive condensed water dropped from the freezing space evaporator 34C. A refrigerating drain pan 34F (see FIG. 9) disposed under the refrigerating space evaporator 34D to receive condensed water dropped from the refrigerating space evaporator 34D may be further included.

The evaporator fan 36 may be a centrifugal fan having a suction port formed in at least one of a lower surface and an upper surface thereof, and a discharge port formed in a portion other than the upper surface and the lower surface. At least a portion of the centrifugal fan may be disposed to overlap the evaporator in the longitudinal direction on the upper side of the evaporator.

The evaporator fan 36 may include a freezing fan 36C disposed over the freezing space evaporator 34C as shown in FIGS. 7 and 10, and a refrigerating fan 36D disposed over the refrigerating space evaporator 34D and spaced apart from the freezing fan 36C in the horizontal direction as shown in FIGS. 7 and 9.

The freezing fan 36C may be accommodated together with the freezing space evaporator 34C in the first evaporator chamber S5. Since a freezing drain pan 34E is disposed under the freezing space evaporator 34C the freezing fan 36C may be preferably disposed on the opposite side of the freezing drain pan 34E with respect to the freezing space evaporator 34C and may be disposed horizontally over the freezing space evaporator 34C.

The freezing fan 36C may be disposed closer to one of the rear body 49 and the front body 50 of the cooling module body 41 in the front-rear direction Y. The freezing fan 36C may be disposed closer to the rear body 49 of the cooling module body 41 in consideration of the position of the lower outlet duct 15 or the upper outlet duct 17 in the front-rear direction Y.

The rotational axis of the freezing fan 36C may be a vertical center axis, and the freezing fan 36C may suck cold air of the freezing space evaporator 34C, positioned under the freezing fan 36C, in the upper direction, and discharge the cold air in the horizontal direction.

The lower inlet duct 16 may have one end communicating with the first evaporator chamber S5, the freezing fan 35C disposed in the first evaporator chamber S5 may be in direct communication with the lower outlet duct 15 or may communicate with the lower outlet duct 15 through a separate connecting duct 38, and the cold air of the lower storage space may pass through the lower inlet duct 16, the first evaporator chamber S5, and the lower outlet duct 15 sequentially and be then discharged to the lower storage space again.

Meanwhile, THE refrigerating fan 36D may be accommodated together with the refrigerating space evaporator 34D in the second evaporator chamber S6.

Since a refrigerating drain pan 34F is disposed below the refrigerating space evaporator 34D, the refrigerating fan 36D is preferably arranged on the opposite side to the refrigerating drain pan 34F with respect to the refrigerating space evaporator 34D, and may be arranged horizontally over the refrigerating space evaporator 34D.

The rotational axis of the refrigerating fan 36D may be a vertical center axis, and the freezing fan 36C may suck cold air of the refrigerating space evaporator 34D, positioned under the refrigerating fan 36D, in the upper direction, and discharge the cold air in the horizontal direction.

The refrigerating fan 36D may be disposed closer to one of the rear body 49 and the front body 50 of the cooling module body 41 in the front-rear direction Y. The refrigerating fan 36D may be disposed closer to the rear body 49 of the cooling module body 41 in consideration of the position of the lower outlet duct 15 or the upper outlet duct 17 in the front-rear direction Y.

An upper inlet 46A may be formed on the upper surface of the cooling module 3. The upper inlet 46A may suck cold air from a storage space (that is, the upper storage space), located on the more upper side among the freezing space F and the refrigerating space R, to the heat absorption part A. The upper inlet 46A may communicate with the second evaporator chamber S6.

The upper storage space may be in direct communication with the upper inlet 46A, and the cold air of the upper storage space may be sucked into the heat absorption part A through the upper inlet 46A. The upper storage space may be connected to an upper inlet and a separate upper inlet duct, and in this case, of cause, cold air of the upper storage space may be sucked into the heat absorption part A through the upper inlet duct and the upper inlet 45A.

One end of the upper outlet duct 17 may be in communication with the refrigerating fan 36D disposed in the second evaporator chamber S6, and the cold air of the upper storage space may pass through the upper inlet 4A of the cooling module 3, the second evaporator chamber S6 and the upper outlet duct 17 sequentially and may be then discharged to the upper storage space.

Meanwhile, the cooling module 3 may further include a connecting duct 38 connecting a discharge port of one of the freezing fan 36C and the refrigerating fan 34D and the lower outlet duct 15.

The connecting duct 38 may connect the lower outlet duct 15 and an evaporator fan that blows cold air to the lower storage space and the cold air cooled by the evaporator 34 may pass through the connecting duct 48 and the lower outlet duct 15 sequentially and may be then discharged to the lower storage space.

When the refrigerating space R is located over the freezing space F, the connecting duct 38 may be arranged to communicate the discharge port of the freezing fan 36C with the lower outlet duct 15, as shown in FIG. 10, and in this case, the connecting duct 38 is disposed to extend at the rear of the freezing space evaporator 34C in the longitudinal direction Z to guide the cold air discharged to the discharge port of the freezing fan 36C to the inside of the lower outlet duct 15.

The cooling module body 41 may be formed with a through hole through which a portion of the lower outlet duct 15 or a portion of the connecting duct 38 passes. In addition, the cooling module barrier 40 may be formed with a through hole through which a portion of the lower outlet duct 15 or a portion of the connecting duct 38 passes.

On the other hand, the heat absorption part A may further include a heat absorption part insulating material 39 for insulating the evaporator 34 from the outside. The heat absorption part insulating material 39 may be installed on the inner surface of the cooling module body 41. The heat absorption part insulating material 39 may be installed on the cooling module barrier 40. When the cooling module barrier 40 has a hexahedral shape, the heat absorption part insulating material 39 may be installed on at least one of an outer surface and an inner surface of the cooling module barrier 40.

The heat absorption part insulating material 39 may be installed on the heat absorption part barrier 37. The heat absorption part insulating material 39 may be installed on one surface of the heat absorption part barrier 37 facing the freezing space evaporator 34C and the other surface of the heat absorption part barrier 37 facing the refrigerating space evaporator 34D.

The heat absorption part insulating material 39 may be a insulating material having a higher insulating performance than the insulating material 19 of the body 1. The heat absorption part insulating material 39 may be thinner than the insulating material 19 of the body 1. The heat absorption part insulating material 39 may be made of a vacuum insulation panel (VIP), and the insulating material 19 of the body 1 may be a conventional insulating material such as polyurethane.

When the heat absorption part insulating material 39 is a vacuum insulation panel (VIP), it is possible to maximize the heat absorption part accommodating space S4, thus making the cooling module 3 as compact as possible while maximizing the size of the evaporator 34.

Hereinafter, the heat radiating part B will be described in detail.

It is preferable that the heat radiating part B is disposed such that a length thereof in the longitudinal direction Y, that is, the height is low. The compressor 31 is preferably installed such that the overall height of the heat radiating part B is not high.

A length of the compressor 31 in a first direction, which is a movement direction of the piston 142 (see FIG. 4) may be greater than a length of the compressor 31 in a second direction which is orthogonal to the movement direction of the piston 142.

The compressor 31 may be laid laterally to extend in the horizontal direction. The compressor 31 may be disposed to extend in the lateral direction X or may be disposed to extend in the front-rear direction Y. The compressor 31 is not limited to being disposed to extend in the lateral direction X or the front-rear direction Y, and of course, the compressor 31 may be disposed to extend in the inclined directions inclined with the lateral direction X and the front-rear direction Y, respectively.

When the compressor 31 is disposed to extend in the lateral direction X, the piston 142 may reciprocate in the lateral direction X. When the compressor 31 may be arranged to extend in the front-back direction X, the piston 142 may reciprocate in the front-back direction Y. When the compressor 31 is arranged to extend in the inclined direction, the piston 142 may reciprocate in the inclined direction.

When the compressor 31 is laid sideways and arranged horizontally, the height H3 of the compressor 31 may be shorter than the length L5 of the compressor 31 in the horizontal direction as shown in FIGS. 7 and 8.

The height H3 of the compressor 31 may be 0.8 times or less of the length L5 of the compressor 31 in the horizontal direction. The condenser 32 may be arranged to extend in the longitudinal direction of the compressor 31. The longitudinal direction of the condenser 32 may be identical to the longitudinal direction of the compressor 31. That is, referring to FIGS. 7 and 8, the length L7 of the condenser 32 in the horizontal direction may be greater than the length L8 of the condenser 32 in the vertical direction. A length of the condenser 32 in the first direction may be greater than a length of the condenser 32 in the second direction.

When the piston 142 of the compressor 31 reciprocates in the lateral direction X, the length of the condenser 32 in the lateral direction X may be greater than the length of the condenser 32 in the longitudinal direction and the length of the condenser 32 in the front-rear direction Y.

When the piston 142 of the compressor 31 reciprocates in the front-rear direction Y, the length of the condenser 32 in the front-rear direction Y may be greater than the length of the condenser 32 in the longitudinal direction and the length of the condenser 32 in the lateral direction X.

The condenser fan 35 may be disposed between the condenser 32 and the compressor 31. The condenser fan 35 may be disposed in front of the condenser 32, and the compressor 31 may be disposed in front of the condenser fan 35.

The condenser fan 35 may face the condenser 32 and the compressor 31 in the front-rear direction Y.

The condenser fan 35 may be arranged to extend in the longitudinal direction of the compressor 31. The longitudinal direction of the condenser fan 35 may be identical to and the longitudinal direction of the compressor 31. A length of the condenser fan 35 in the first direction may be greater than a length of the condenser fan 35 in the second direction.

When the piston 142 of the compressor 31 reciprocates in the lateral direction X, the length of the condenser fan 35 in the lateral direction X may be greater than the length of the condenser fan 35 in the longitudinal direction and the length of the condenser fan 35 in the front-rear direction Y.

When the piston 142 of the compressor 31 reciprocates in the front-rear direction Y, the length of the condenser fan 35 in the front-rear direction Y may be greater than the length of the condenser 32 in the longitudinal direction and the length of the condenser fan 35 in the lateral direction X.

Meanwhile, the cooling module 3 may be formed with inlets 42 and 43 through which outdoor air is sucked into the heat radiating part B, and an outlet 44 through which air passing through the heat radiating part B is discharged. The inlets 42 and 43 and the outlet 44 may be formed in the cooling module body 41.

The cooling module body 41 may be formed with inlets 42 and 43 through which outdoor air is sucked into the heat radiating part B, and an outlet 44 through which air passing through the heat radiating part B is discharged to the outside of the cooling module 3. The rear body 49 and the side body 47 of the cooling module body 41 may surround the heat radiating part B.

The condenser 32 may be preferably disposed before the compressor 31 in the flow direction of the air passing through the heat radiating part B. The condenser 32 may be preferably disposed closer to the inlets 42, 43 than the outlet 44, and the compressor 31 may be preferably disposed closer to the outlet 44 than the inlets 42, 43.

The inlets 42 and 43 may include a rear inlet 42 formed in the rear body 49 and a side inlet 43 formed in the side body 47. The outlet 44 may be formed to be spaced apart from the side inlet 43 in the front-rear direction in front of the side inlet 43 of the side body 47.

The heat radiating part B may be positioned eccentrically on one side of the left and right sides of the cooling module 3, and the side inlet 43 and the outlet 44 may be formed only in one side body 47 closer to the condenser 32, the condenser fan 35 and the compressor 31 among the pair of side bodies. The rear inlet 42 may be formed only in an area of the rear body 49 that faces the condenser 32 in the front-rear direction Y.

Meanwhile, referring to FIG. 7, the length L9 of the condenser fan 35 in the horizontal direction may be greater than the length L7 of the condenser 32 in the horizontal direction and the length L5 of the compressor 31 in the horizontal direction. The condenser fan 35 may be disposed to extend in the lateral direction X, and the length of the condenser fan 35 in the lateral direction X may be greater than the length of the condenser 32 in the lateral direction and the left and the length of the compressor 31 in the lateral direction individually.

The condenser fan 35 may include a pair of fan units 35A and 35B sequentially arranged in the first direction. The pair of fan units 35A and 35B may be sequentially arranged in the longitudinal direction of the compressor 31. The condenser fan 35 may include a pair of fan units 35A and 35B disposed in the lateral direction between the condenser 32 and the compressor 31.

The fan units 35A and 35B may include a shroud for guiding outdoor air, a motor installed in the shroud, and a fan installed on the rotating shaft of the motor. Fans of the fan units 35A and 35B may be propeller fans.

The length of each of the pair of fan units 35A and 35B in the lateral direction X may be shorter than the length of the condenser 32 in the lateral direction X and the length of the compressor 31 in the lateral direction, individually. However, the sum of length of any one of the pair of fan units 35A and 35B in the lateral direction and the length of the other of the pair of fan units 35A and 35B in the lateral direction may be greater than the length of the condenser 32 in the lateral direction and the length of the compressor 31 in the lateral direction individually.

The pair of fan units 35A and 35B may face different areas of the condenser 32, and the outdoor air is heat-exchanged with the condenser 32 and then distributed and sucked to the pair of fan units 35A and 35B. The air blown from the pair of fan units 35A and 35B may be blown to the heat exchanger 31.

When the condenser fan 35 is composed of one large fan unit, its overall height is high, while, as in the present embodiment, when the condenser fan 35 is composed of a pair of fan units 35A and 35B, the length of the condenser fan 35 in the longitudinal direction, that is, the height of the condenser fan 35 may be low and the cooling module 3 may be lower than the height when one large fan unit is used as the condenser fan 35, thereby making it compact.

As described above, the condenser fan 35 including the pair of fan units 35A and 35B may cause noise due to a beat phenomenon. In order to reduce such noise, the plurality of fan units 35A and 35B may preferably operate at the same rotation speed.

The pair of fan units 35A and 35B may be configured such that their respective flow rates are adjustable, and in this case, it may be preferable to detect the rotation speeds of the pair of fan units 35A and 35B and then change rotation speeds.

For example, as a result of detection of the rotation speed of each of the pair of fan units 35A and 35B, when the rotation speed of the first fan unit and the rotation speed of the second fan unit are the same or the difference therebetween is within a set value, the first fan unit and the second fan unit may be controlled to maintain the rotation speeds of the first fan unit and the second fan unit. On the other hand, when a difference between the rotation speed of the first fan unit and the rotation speed of the second fan unit exceeds the set value, the rotation speed of the first fan unit and the rotation speed of the second fan unit may be adjusted to control the first fan unit and the second fan unit such that the rotation speeds are equal to each other or the difference therebetween is within the set value.

Hereinafter, the operation of the present disclosure configured as described above is as follows.

For convenience, a description will be given by taking, as an example, a case where the freezing space F is a lower storage space positioned below the body barrier 11 and the refrigerating chamber R is an upper storage space positioned above the body barrier 11.

The cooling module 3 may be inserted into and accommodated in the cooling module accommodating space S1 at the rear or the side of the body 1 and may be used in a state in which the cooling module 3 is mounted to the body 1. When the cooling module 3 is mounted to the body 1, the cooling module 3 may be connected to the lower outlet duct 15, the lower inlet duct 16, and the upper outlet duct 17, individually, and may be operated in a state of being connected to the lower outlet duct 15, the lower inlet duct 16 and the upper outlet duct 17, individually.

When the compressor 31 is operated, the compressor 31 may compress refrigerant, and the refrigerant compressed by the compressor 31 may pass through the condenser 32, the expansion device, and the evaporator 34, sequentially and be then collected to the compressor 31. When the compressor 31 is operated as described above, the refrigerant may not flow to the body 1 but may flow only inside the cooling module 3.

When the freezing fan 36C is operated, cold air in the freezing space F may be sucked into the lower inlet duct 16, pass through the lower inlet duct 16, and be sucked into the first evaporation chamber S5 in the lower inlet duct 16.

The cold air sucked into the first evaporator chamber S5 may lose heat to the refrigerant passing through the freezing space evaporator 34C while flowing horizontally along the freezing space evaporator 34C, and be sucked into the freezing fan 36C to be blown.

The cold air blown from the freezing fan 36C may flow through the connecting duct 38 to the lower outlet duct 15, and may be discharged to the freezing space F through a plurality of lower discharge holes 15A of the lower outlet duct 15.

When the refrigerating fan 36D is operated, cold air of the refrigerating space R may be sucked into the upper inlet 46C and be then sucked into the second evaporator chamber S6.

The cold air sucked into the second evaporator chamber S6 may lose heat to the refrigerant passing through the refrigerating space evaporator 34D while flowing horizontally along the refrigerating space evaporator 34D, and be sucked into the refrigerating fan 36D to be blown.

The cold air blown from the refrigerating fan 36D may flow to the upper outlet duct 17, and may be discharged to the freezing space F through a plurality of lower discharge holes 17A of the upper outlet duct 17.

That is, in the refrigerator of the present embodiment, the cold air of the storage space formed in the body 1 may move to the first evaporator chamber S5 and the second evaporator chamber S6 of the cooling module 3 and be then discharged to the storage chamber again, and the refrigerant may cool cold air of the storage space while circulating in the inside of the cooling module 3.

Meanwhile, when the condenser fan 35 is operated, air outside the refrigerator may be sucked into the cooling module 3 through the rear inlet 42 and the side inlet 43, be heat-exchanged with refrigerant while passing through the condenser 32 to enable the refrigerant to radiate heat, and then may be blown to the compressor 31 by passing through the pair of fan units 35A and 35B. The outdoor air blown to the compressor 31 may enable the compressor 31 to radiate heat and then be discharged to the side of the body 1 through the outlet 44.

FIG. 11 is a plan view showing a cooling module according to another embodiment of the present disclosure and FIG. 12 is a cross-sectional view showing a freezing space evaporator and a freezing space according to another embodiment of the present disclosure.

As shown in FIGS. 11 and 12, a freezing fan 36C' of the present embodiment may be disposed closer to the front body 50 of the front body 50 of the cooling module body 41 than the rear body 49 of the cooling module body 41.

The cooling module 3 of the present embodiment may discharge cold air from the upper portion of the lower storage space to the lower storage space, and the cooling module 3 may directly discharge cold air to the lower storage space in consideration of the characteristics that the cold air cooled by the evaporator drops in the direction of gravity. In this case, the refrigerator does not need the lower outlet duct 15, as shown in FIG. 1, and the cold air discharged from the cooling module 3 may be directly discharged to the lower storage space.

As in the present embodiment, when the cooling module 3 directly discharges the cold air to the lower storage space, the cooling module 3 may preferably discharge the cold air at a position closer to the front end among the rear end and the front end and, to this end, the freezing fan 36C' may be disposed closer to the front body 50 of the cooling module body 41 than the rear body 49 of the cooling module body 41.

The present embodiment may further include a separate connecting duct 38' which communicates the freezing fan 36C' with the lower storage space, and the connecting duct 38' may be disposed to guide cold air discharged to the discharge port of the freezing fan 36C' to the lower storage space. The connecting duct 38' may be disposed to extend in the longitudinal direction in front of the freezing space evaporator 34C to guides the air discharged from the freezing fan 36C' to the upper portion of the lower storage space.

Since the present embodiment is the same or similar to the one embodiment of the present disclosure other than the freezing fan 36C' and the connecting duct 38', the detailed description thereof will be omitted.

FIG. 13 is a cross-sectional view showing a freezing space evaporator and a freezing space according to still another embodiment of the present disclosure.

The present embodiment may include the lower outlet duct 15 of the one embodiment of the present disclosure, the freezing fan 36C' disposed closer to the front body 50 of the cooling module body 41 than the front body 50 of the cooling module body 41 and may further include a connecting duct 38" connecting the freezing fan 36C' and the lower outlet duct 15.

In the present embodiment, cold air blown from the freezing fan 36C' may flow to the lower outlet duct 15 through the connecting duct 38", and to this end, the connecting duct 38" may have a shape bent at least once.

The freezing fan 36C' and the lower outlet duct 15 may be positioned so as not to overlap each other in the longitudinal direction Z, and the connecting duct 38" may communicate the freezing fan 36C' with the lower outlet duct 15 which do not overlap each other in the longitudinal direction Z. For example, the connecting duct 38" may include a first duct 38A disposed to extend in the longitudinal direction Z in front of the freezing space evaporator 34C, and a second duck 38B communicating with the first duct 38A and disposed to extend in the front-rear direction Y to be connected to the lower outlet duct 15.

In the present embodiment, other configurations and operations other than the freezing fan 36C' and the connecting duct 38" are the same as or similar to those of the embodiment of the present disclosure, and a detailed description thereof will be omitted.

On the other hand, the present disclosure is not limited to the above embodiments, and the cooling module 3 may include a pair of heat absorption parts A spaced apart from each other, the heat radiating part B may be disposed between the pair of heat absorption parts A or the inlets 42 and 43 and the outlet 44 of the cooling module 3 may also be formed on the rear surface of the cooling module 3, of course.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

Therefore, the exemplary embodiments of the present disclosure are provided to explain the spirit and scope of the present disclosure, but not to limit them, so that the spirit and scope of the present disclosure is not limited by the embodiments.

The scope of the present disclosure should be construed on the basis of the accompanying claims, and all the technical ideas within the scope equivalent to the claims should be included in the scope of the present disclosure.

INDUSTRIAL APPLICABILITY

According to the embodiments of the present disclosure, there is an advantage in that the connection between the compressor and the evaporator is easy, and there is an advantage in that the service such as repair or assembly is easy, thus achieving remarkable industrial applicability.

The invention claimed is:

1. A refrigerator comprising:

a body in which first and second storage spaces that are arranged in a vertical direction, the body being formed with a cooling module accommodating space;

a body barrier disposed between the first and second storage spaces, the body barrier including an insulation material;

a door to open and close the at least one storage space; and a cooling module accommodated in the cooling module accommodating space, wherein the cooling module includes:

a cooling module body containing a heat radiating part including a compressor that compresses refrigerant, a condenser that condenses the refrigerant compressed by the compressor and a condenser fan that blows air to the condenser;

a heat absorption part including an evaporator that evaporates the refrigerant and an evaporator fan that circulates cold air of the first and second storage spaces to the evaporator and the first and second storage spaces; and a cooling module barrier to separate the heat radiating part and the heat absorption part, wherein the cooling accommodating space is recessed from a rear surface of the body such that the body barrier and the cooling module are arranged in a front-rear direction, and wherein the body further includes a facing surface defining a surface of the body barrier such that the facing surface closes a front surface of the cooling module.

2. The refrigerator of claim 1, wherein the cooling module accommodating space is formed to extend in a lateral direction on a rear side of the body barrier.

3. The refrigerator of claim 1, wherein the cooling module has a height higher than a height of the body barrier.

4. The refrigerator of claim 1, wherein at least one of the compressor, the evaporator and the condenser faces the body barrier in the front-rear direction.

5. The refrigerator of claim 1, wherein the evaporator is spaced apart from a rear end of the body barrier in the front-rear direction, and wherein a distance between a rear end of the body barrier and the evaporator is shorter than a length of the body barrier in the front-rear direction.

6. The refrigerator of claim 1, wherein the evaporator is disposed horizontally in the cooling module, and the evaporator includes a refrigerant tube through which the refrigerant passes, and at least one heat transfer fin connected to the refrigerant tube.

7. The refrigerator of claim 1, wherein the evaporator includes a first evaporator that cools the freezing first storage space, and a second evaporator that cools the second storage space, and wherein the cooling module further includes a heat absorption part barrier to separate the first evaporator and the second evaporator.

8. The refrigerator of claim 7, wherein a length of the first evaporator in the lateral direction is greater than a length of the second evaporator in the lateral direction.

9. The refrigerator of claim 8, wherein the second evaporator is disposed between the first evaporator and the heat radiating part.

10. The refrigerator of claim 1, wherein the heat absorption part includes a heat absorption part insulating material to insulate the evaporator, and the heat absorption part insulating material is thinner than an insulating material of the body.

11. The refrigerator of claim 1, wherein the condenser fan is disposed in front of the condenser, the compressor is disposed in front of the condenser fan, and the condenser fan faces the condenser and the compressor in the front-rear direction.

12. The refrigerator of claim 1, wherein the cooling module body includes:

an inlet through which the air passes into the heat radiating part and an outlet through which the air passing through the heat radiating part is discharged, a rear body and a side body which surround the heat radiating part, wherein the inlet includes a rear inlet formed at the rear body and a side inlet formed at the side body, and the outlet is spaced apart from the side inlet in the front-rear direction at the side body.

13. The refrigerator of claim 1, wherein a height of the compressor is 0.8 times or less than a length of the compressor in a horizontal direction, and a length of the condenser in the horizontal direction is greater than a length of the condenser in a longitudinal direction.

14. The refrigerator of claim 1, wherein a length of the condenser fan in a horizontal direction is greater than a length of the condenser in the horizontal direction, and is greater than a length of the compressor in the horizontal direction, and wherein the condenser fan includes a pair of fan units disposed in a lateral direction between the condenser and the compressor.

15. The refrigerator of claim 1, wherein the cooling module body forms an outer surface of the cooling module and is accommodated in the cooling module accommodating space, and the cooling module body includes a lower body and an upper body spaced apart from each other in a longitudinal direction;

a pair of side bodies spaced apart from each other in a lateral direction, a rear body connecting rear portions of the pair of side bodies, a front body connecting front portions of the pair of side bodies, and wherein the heat radiating part and the heat absorption part are disposed between the pair of side bodies.

16. The refrigerator of claim 1, wherein the evaporator fan is a centrifugal fan in which a suction port is formed in at least one of a lower surface and an upper surface of the evaporator fan, and in which a discharge port is formed in a portion other than the upper surface and the lower surface, wherein at least a portion of the centrifugal fan is disposed over the evaporator to overlap with the evaporator in the longitudinal direction.

17. The refrigerator of claim 1, wherein the evaporator includes a first evaporator to cool the first storage space, and a second evaporator to cool the second storage space, wherein the evaporator fan includes a first fan disposed above the first evaporator, and a second fan disposed above the second evaporator and spaced apart from the first fan in a horizontal direction.

18. The refrigerator of claim 17, wherein the body includes an upper outlet duct located at the second storage space, the upper outlet duct including a plurality of upper discharge holes through which cold air blown from the heat absorption part is discharged, and wherein the cooling module is formed with an upper inlet through which the cold air of the second storage space is sucked into the heat absorption part.

19. The refrigerator of claim 17, wherein the body includes a lower inlet duct located at the first storage space, the lower inlet duct including a lower inlet through which cold air is sucked in from the second storage space, and guides the cold air sucked into the lower inlet to the heat absorption part.

20. The refrigerator of claim 17, wherein the body includes a lower outlet duct located at the first storage space, the lower outlet duct including a plurality of lower discharge holes through which cold air blown from the heat absorption part is discharged, and wherein the cooling module further includes a connecting duct connecting a discharge hole of one of the first fan and the lower outlet duct.

21. A refrigerator comprising:

a body having a first storage space and a second storage space located vertically above the first storage space;

a body barrier disposed between the first and second storage spaces, the body barrier including an insulation material;

a door to open and close the at least one storage space;

a cooling module accommodating space formed at the body; and a cooling module accommodated in the cooling module accommodating space, wherein the cooling module includes:

a cooling module body containing a heat radiating part including a compressor that compresses refrigerant, a condenser that condenses the refrigerant compressed by the compressor and a condenser fan that blows air to the condenser;

a heat absorption part including an evaporator that evaporates the refrigerant and an evaporator fan that circulates cold air of the first and second storage spaces to the evaporator and the first and second storage spaces; and a cooling module barrier to separate the heat radiating part and the heat absorption part, and an outlet duct in communication with an outlet of the cooling module and configured to discharge the cold air blown from the heat absorption part to the first storage space; and wherein evaporator fan is located vertically above the evaporator, and wherein the cooling module further includes a connecting duct that extends downward from a discharge port of the evaporator fan and is connected to the outlet located under the evaporator.

22. A refrigerator comprising:

a body having a first storage space and a second storage space;

a body barrier disposed between the first and second storage spaces, the body barrier including an insulation material;

a door to open and close the at least one storage space;

a cooling module accommodating space formed at the body; and a cooling module accommodated in the cooling module accommodating space, wherein the cooling module includes:

a cooling module body containing a heat radiating part including a compressor that compresses refrigerant, a condenser that condenses the refrigerant compressed by the compressor and a condenser fan that blows air to the condenser, the heat radiating part being disposed eccentrically on one of lateral sides of the cooling module;

a heat absorption part including a first evaporator to cool the first storage space, a second evaporator to cool the second storage space, a first evaporator fan that circulates cold air of the first storage space to the first evaporator and the first storage space and a second evaporator fan that circulates cold air of the second storage space to the second evaporator and the second storage space, the heat absorption part being disposed at a lateral side of the heat radiating part; and a cooling module barrier to separate the heat radiating part and the heat absorption part, and wherein the second evaporator is disposed between the first evaporator and the heat radiating part.

23. A refrigerator comprising:

a body having a first storage space and a second storage space;

a body barrier disposed between the first and second storage spaces, the body barrier including an insulation material;

a door to open and close the at least one storage space;

a cooling module accommodating space formed at the body; and a cooling module accommodated in the cooling module accommodating space, wherein the cooling module includes:

a cooling module body containing a heat radiating part including a compressor that compresses refrigerant, a condenser that condenses the refrigerant compressed by the compressor and a condenser fan that blows air to the condenser;

a heat absorption part including an evaporator that evaporates the refrigerant and an evaporator fan that circulates cold air of the first and second storage spaces to the evaporator and the first and second storage spaces; and a cooling module barrier to separate the heat radiating part and the heat absorption part, and wherein the cooling module body includes first and second outlets through which air is sucked into the heat radiating part and an outlet through which air passing through the heat radiating part is discharged, wherein the cooling module body further includes a pair of side bodies and a rear body that are exposed to an outside of the body, wherein the first and second inlets are formed in one of the pair of side bodies and the rear body, and the outlet is formed in the one of the pair of side bodies.

24. A refrigerator comprising:

a body in which at least one storage space and a cooling module accommodating space are formed;

a door to open and close the at least one storage space; and a cooling module accommodated in the cooling module accommodating space, wherein the cooling module includes:

a cooling module body containing a heat radiating part including a compressor that compresses refrigerant, a condenser that condenses the refrigerant compressed by the compressor and a condenser fan that blows air to the condenser, the heat radiating part being disposed eccentrically on one of lateral sides of the cooling module;

a heat absorption part including an evaporator that evaporates the refrigerant and an evaporator fan that circulates cold air of the storage space to the evaporator and the storage space, the heat absorption part being disposed at a lateral side of the heat radiating part; and a cooling module barrier to separate the heat radiating part and the heat absorption part, wherein the cooling module body includes:

an inlet through which the air passes into the heat radiating part and an outlet through which the air passing through the heat radiating part is discharged, a rear body and a side body which surround the heat radiating part, wherein the inlet includes a rear inlet formed at the rear body and a side inlet formed at the side body, and the outlet is spaced apart from the side inlet in the front-rear direction at the side body.

25. A refrigerator comprising:

a body in which at least one storage space and a cooling module accommodating space are formed;

a door to open and close the at least one storage space; and a cooling module accommodated in the cooling module accommodating space, wherein the cooling module includes:

a cooling module body containing a heat radiating part including a compressor that compresses refrigerant, a condenser that condenses the refrigerant compressed by the compressor and a condenser fan that blows air to the condenser, the heat radiating part being disposed eccentrically on one of lateral sides of the cooling module;

a heat absorption part including an evaporator that evaporates the refrigerant and an evaporator fan that circulates cold air of the storage space to the evaporator and the storage space, the heat absorption part being disposed at a lateral side of the heat radiating part; and a cooling module barrier to separate the heat radiating part and the heat absorption part, wherein a height of the compressor is 0.8 times or less than a length of the compressor in a horizontal direction, and wherein a length of the condenser in the horizontal direction is greater than a length of the condenser in a longitudinal direction.

26. A refrigerator comprising:

a body in which at least one storage space and a cooling module accommodating space are formed;

a door to open and close the at least one storage space; and a cooling module accommodated in the cooling module accommodating space, wherein the cooling module includes:

a cooling module body containing a heat radiating part including a compressor that compresses refrigerant, a condenser that condenses the refrigerant compressed by the compressor and a condenser fan that blows air to the condenser, the heat radiating part being disposed eccentrically on one of lateral sides of the cooling module;

a heat absorption part including an evaporator that evaporates the refrigerant and an evaporator fan that circulates cold air of the storage space to the evaporator and the storage space, the heat absorption part being disposed at a lateral side of the heat radiating part; and a cooling module barrier to separate the heat radiating part and the heat absorption part, wherein a length of the condenser fan in a horizontal direction is greater than a length of the condenser in the horizontal direction, and is greater than a length of the compressor in the horizontal direction, and wherein the condenser fan includes a pair of fan units disposed in a lateral direction between the condenser and the compressor.

* * * * *